US009595765B1

(12) United States Patent
Valayil

(10) Patent No.: US 9,595,765 B1
(45) Date of Patent: Mar. 14, 2017

(54) SLOTTED WAVEGUIDE ANTENNA WITH METAMATERIAL STRUCTURES

(71) Applicant: Continental Microwave & Tool Co., Inc., Exeter, NH (US)

(72) Inventor: Minu K. Valayil, Manchester, NH (US)

(73) Assignee: Continental Microwave & Tool Co., Inc., Exeter, NH (US)

( * ) Notice: Subject to any disclaimer, the term of this patent is extended or adjusted under 35 U.S.C. 154(b) by 269 days.

(21) Appl. No.: 14/324,172

(22) Filed: Jul. 5, 2014

(51) Int. Cl.
*H01Q 13/18* (2006.01)
*H01Q 15/00* (2006.01)

(52) U.S. Cl.
CPC ..... *H01Q 13/18* (2013.01); *H01Q 15/0086* (2013.01)

(58) Field of Classification Search
CPC ..... H01C 21/0043; H01C 21/005; H01C 21/0062; H01C 21/064; H01C 15/04; H01C 15/10; H01C 13/0233; H01C 13/12; H01C 13/18; H01C 13/22; H01C 13/28; H01C 15/006; H01C 15/0086; H01C 15/08; H01C 13/10; H01C 13/103; H01C 15/02; H01C 19/06; H01C 13/20; H01C 15/00; H01C 15/0006–15/248
USPC ..... 343/746, 762, 767, 768, 771, 772
See application file for complete search history.

(56) References Cited

U.S. PATENT DOCUMENTS 7,379,029 B2 * 5/2008 Rolnik ..... H01Q 21/0006 343/770
7,474,456 B2 1/2009 Wang
7,525,506 B2 * 4/2009 Wu ..... H01Q 1/425 343/872
7,525,711 B1 * 4/2009 Rule ..... B82Y 20/00 333/235
7,538,946 B2 * 5/2009 Smith ..... B82Y 20/00 359/569

(Continued)

FOREIGN PATENT DOCUMENTS

WO WO2012/177946 A2 6/2012

OTHER PUBLICATIONS

IEEE Xplore search results, search conducted Dec. 20, 2016.*

(Continued)

*Primary Examiner* — Graham Smith
*Assistant Examiner* — Patrick Holecek
(74) *Attorney, Agent, or Firm* — Lizotte Law Office, PLLC; Donna L. Lizotte

(57) ABSTRACT

The present disclosure relates to a slotted waveguide antenna system. The slotted waveguide antenna system includes a waveguide that includes a first surface and a plurality of slots defined in the first surface and a metamaterial structure positioned external to the waveguide. The metamaterial structure is configured to exhibit a negative effective permittivity and a negative effective permeability for an operating frequency range. The metamaterial structure includes a split ring resonator, a substrate and a wire structure. The wire structure includes a first portion, a second portion and a third portion, the second portion coupled between the first portion and the second portion, the first portion oriented parallel to the third portion, the second portion oriented perpendicular to the first portion and the third portion. A dimension of at least one of the first portion and the third portion is related to the operating frequency range.

20 Claims, 9 Drawing Sheets

(56) References Cited

U.S. PATENT DOCUMENTS

| | | | | |
|---|---|---|---|---|
| 7,580,604 | B2 * | 8/2009 | D'Aguanno | B82Y 20/00 359/321 |
| 7,593,170 | B2 * | 9/2009 | Wu | B82Y 20/00 252/570 |
| 7,646,524 | B2 * | 1/2010 | Tonucci | G02F 1/015 257/431 |
| 8,130,171 | B2 * | 3/2012 | Lam | H01Q 15/02 343/872 |
| 8,237,516 | B2 * | 8/2012 | Wyland | H01L 23/64 333/12 |
| 8,350,759 | B2 | 1/2013 | Ju et al. | |
| 8,451,072 | B2 * | 5/2013 | Wyland | H01L 23/66 333/12 |
| 8,547,281 | B2 | 10/2013 | Ryou et al. | |
| 9,293,834 | B2 * | 3/2016 | Latrach | H01Q 15/0026 |
| 2005/0031295 | A1 | 2/2005 | Engheta et al. | |
| 2008/0165079 | A1 | 7/2008 | Smith et al. | |
| 2010/0156573 | A1 * | 6/2010 | Smith | H01P 3/081 333/239 |
| 2010/0277374 | A1 | 11/2010 | Ju et al. | |

OTHER PUBLICATIONS

Garg, B. and Sharma, N., Analysis and design of left handed metamaterial to ameliorate the bandwidth and return loss using CST, Current Research in Engineering, Science and Technology (CREST) Journals, May 2013, pp. 73-79, vol. 01, Issue 03, IDRIO Tech, India.

Smith, D.R., et al., Composite Medium with Simultaneously Negative Permeability and Permittivity, Physical Review Letters, May 1, 2000, pp. 4184-4187, vol. 84, No. 18, The American Physical Society, Ridge, NY, US.

Xu, Z.X., et al., Controllable Absorbing Structure of Metamaterial at Microwave, Progress In Electromagnetics Research, 2007, pp. 117-125, PIER 69, publisher city/country unknown.

Smith, D.R.,et al., Direct calculation of permeability and permittivity for a left-handed metamaterial, Applied Physics Letters, 2000, pp. 2246-2248, Issue 14, American Institute of Physics (AIP) Publishing, Melville, NY, US.

Varadan, V.V., and Tellakula, A.R., Effective properties of split-ring resonator metamaterials using measured scattering parameters: Effect of gap orientation, Journal of Applied Physics, 2006, pp. 034910-1-034910-8, vol. 100, Issue 4, American Institute of Physics (AIP) Publishing, Melville, NY, US.

Schurig, D., et al., Electric-field-coupled resonators for negative permittivity metamaterials, Applied Physics Letters, 2006, pp. 041109-1-041109-3, vol. 88, Issue 4, American Institute of Physics (AIP) Publishing, Melville, NY, US.

Veselago, V.G., The Electrodynamics of Substances with Simultaneously Negative Values of Permittivity and Permeability, Soviet Physics USPEKHI, Jan.-Feb. 1968, pp. 509-514, vol. 10, No. 4, Turpion Ltd, publisher city/country unknown.

Smith, D.R., et al., Electromagnetic parameter retrieval from inhomogeneous metamaterials, Physical Review, 2005, pp. 036617-1-036617-11, vol. 71, Issue 3, The American Physical Society, Ridge, NY, US.

Baena, J.D., et al., Equivalent-Circuit Models for Split-Ring Resonators and Complementary Split-Ring Resonators Coupled to Planar Transmission Lines, IEEE Transactions on Microwave Theory and Techniques, Apr. 2005, pp. 1451-1461, vol. 53, No, 4, IEEE, Piscataway, NJ, US.

Marques, R., et al., Left-Handed-Media Simulation and Transmission of EM Waves in Subwavelength Split-Ring-Resonator-Loaded Metallic Waveguides, Physical Review Letters, Oct. 28, 2002, pp. 183901-1-183901-4, vol. 89, No. 18, The American Physical Society, Ridge, NY, US.

Smith, D.R., et al., Left-Handed Metamaterials, Photonic Crystals and Light Localization, 2000, pp. 1-21, Preprint: NATO-ASI, Heraklion, Crete.

Zhang, Y. and Deng, L.-L., Metamaterial transmission lines based on split-ring resonators (SRRs) and complementary split-ring resonators (CSRRs), 2010 International Conference on Microwave and Millimeter Wave Technology (ICMMT 2010), 2010, 2075-2077, IEEE, Piscataway, NJ, US.

Pendry, JB, Metamaterials and the Control of Electromagnetic Fields, Conference on Coherence and Quantum Optics, OSA Technical Digest (CD) Jun. 13, 2007, Paper CMB2, Optical Society of America, Rochester, NY, US.

Smith, D.R., et al., Metamaterials and Negative Refractive Index, Science, Aug. 6, 2004, pp. 788-792, vol. 305, American Association for the Advancement of Science (AAAS), Washington, DC, US.

Shelby, R.A., et al., Microwave transmission through a two-dimensional, isotropic, left-handed metamaterial, Applied Physics Letters, Jan. 22, 2001, pp. 489-491, vol. 78, No. 4, American Institute of Physics (AIP) Publishing, Melville, NY, US.

Padilla, W.J., et al., Negative refractive index metamaterials, Materialstoday, Jul.-Aug. 2006, pp. 28-35, vol. 9, No. 7-8, Elsevier Ltd, NY, US.

Smith, D.R., et al., Negative refraction of modulated electromagnetic waves, Applied Physics Letters 81 2713, 2002, pp. 2713-2715, vol. 81, No. 15, American Institute of Physics (AIP) Publishing, Melville, NY, US.

Weldon, T.P., et al., A Novel Unit Cell and Analysis for Epsilon Negative Metamaterial, IEEE SoutheastCon, 2011, Mar. 17-20, 2011, IEEE, Piscataway, NJ, US.

Dong, Y. et al., Numerical Studies for Relative Bandwidth of Left-Handed Metamaterials with Split-Ring Resonators, 2009 3rd IEEE International Symposium on Microwave, Antenna, Propagation and EMC Technologies for Wireless Communications, 2009, pp. 821-825, IEEE, Piscataway, NJ, US.

Chen, Y., and Lipton, R., Resonance and Double Negative Behavior in Metamaterials, Arch. Rational Mech. Anal. 209, 2013, pp. 835-868, Springer-Verlag, Berlin, Heidelberg, Germany.

Seetharamdoo, D., Resonant Negative Refractive Index Metamaterials, Metamaterial, 2012, pp. 171-192, Intech, Croatia.

Nicholson, K., et al., Split-Ring Resonator Loaded Slot Array, Proceedings of the Asia-Pacific Microwave Conference, 2011, pp. 1338-1341, Engineers Australia, Barton, Australia.

Daliri, A., et al., Split-Ring Slot in the Broad-Wall of a Rectangular Waveguide, IEEE Antennas and Wireless Propagation Letters, May 20, 2014, pp. 991-994, vol. 13, IEEE, Piscataway, NJ, US.

Li B., et al., Study on High Gain Circular Waveguide Array Antenna with Metamaterial Structure, Progress in Electromagnetics Research (PIER), 2006, pp. 207-219, vol. 60, Pier, publisher city/country unknown.

Ekmekci, E., et al., A tunable multi-band metamaterial design using micro-split SRR structures, Optics Express, Aug. 31, 2009, pp. 16046-16058, vol. 17, No. 18, The Optical Society of America (OSA), US.

Sekretarov, S.S., and Vavriv, D.M., A Wideband Slotted Waveguide Antenna Array for SAR Systems, Progress in Electromagnetics Research (PIER), 2010, pp. 165-176, vol. 11, PIER M, publisher city/country unknown.

Alu, A. and Engheta, N., Physical Insight into the 'Growing' Evanescent Fields of Double-Negative Metamaterial Lenses Using their Circuit Equivalence, arXiv:physics/0408117[physics:optics], Aug. 2004, Cornell University Library, NY, US.

Patel, N., Theory, Simulation, Fabrication and Testing of Double Negative and Epsilon Near Zero Metamaterials for Microwave Applications, Presented to faculty California Polytechnic State University, San Luis Obispo, CA, US.

Liang, L., et al., A study of using the double negative structure to enhance the gain of rectangular waveguide antenna arrays, Progress in Electromagnetics Research (PIER), 2006, pp. 275-286, vol. 65, PIER, publisher city/country unknown.

Wu, B.-I., et al., A study of using metamaterials as antenna substrate to enhance gain, Progress in Electromagnetics Research (PIER), 2005, pp. 295-328, vol. 51, PIER, publisher city/country unknown.

Shelby, R.A., et al., Experimental verification of a negative index of refraction, Science, Apr. 6, 2001, pp. 77-79, vol. 292, No. 5514, American Association for the Advancement of Science (AAAS), Washington, DC, US.

(56) References Cited

OTHER PUBLICATIONS

Liu, H., et al., Study of antenna superstrates using metamaterials for directivity enhancement based on Fabry-Perot resonant cavity, International Journal of Antennas and Propagation, 2013, pp. 1-10, vol. 2013, Hindawi Publishing Corporation, Cairo, Egypt.
Falcone, F., et al., Babinet principle applied to the design of metasurfaces and metamaterials, Physical Review Letters, Nov. 5, 2004, pp. 197401-1 to 197401-4, vol. 93, No. 19, The American Physical Society, Ridge, NY, US.

* cited by examiner

SLOTTED WAVEGUIDE ANTENNA WITH METAMATERIAL STRUCTURES

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND

Field of the Disclosure

This disclosure relates to a slotted waveguide antenna, in particular to a slotted waveguide antenna with metamaterial structures.

Description of Related Art

Generally, slotted waveguide antennas (SWAs) include a rectangular waveguide with slots formed in at least one surface. Electromagnetic energy may be provided to the SWA by a transmission line and/or another waveguide configured to couple a transmitter and/or receiver to the SWA. For example, SWAs may be used in navigational radar applications. SWAs may be configured to operate at one or more frequencies between about 1 gigahertz (GHz) and about 26 GHz.

SWA antenna characteristics, including gain and directivity, are related to a physical size of the SWA. In order to increase gain and/or directivity, the size of the SWA may be increased. Increasing size may result in increased weight and/or mechanical instability. SWA antenna characteristics may be improved without increasing size by adding dielectric material inside the waveguide. Dielectric materials can be lossy (i.e., non-zero loss tangent) and, thus, may detrimentally affect the gain of the SWA.

SUMMARY

The present disclosure relates in one embodiment to a system. The system includes a slotted waveguide antenna and a metamaterial structure positioned external to the waveguide. The slotted waveguide antenna includes a waveguide configured to enclose a waveguide cavity. The waveguide includes a first surface and a plurality of slots defined in the first surface, each slot configured to transmit and receive electromagnetic waves with frequencies in an operating frequency range. The metamaterial structure is configured to exhibit a negative effective permittivity and a negative effective permeability for the operating frequency range. The metamaterial structure includes a split ring resonator comprising an outer split ring and a concentric inner split ring, a substrate, and a wire structure. The wire structure includes a first portion, a second portion and a third portion. The second portion is coupled between the first portion and the second portion. The first portion is oriented parallel to the third portion. The second portion is oriented perpendicular to the first portion and the third portion. A dimension of at least one of the first portion and the third portion is related to the operating frequency range.

The present disclosure relates in one embodiment to an apparatus. The apparatus includes a metamaterial structure configured to exhibit a negative effective permittivity and a negative effective permeability for an operating frequency range. The metamaterial structure includes a split ring resonator, a substrate and a wire structure. The split ring resonator includes an outer split ring and a concentric inner split ring. The wire structure includes a first portion, a second portion and a third portion. The second portion is coupled between the first portion and the second portion. The first portion is oriented parallel to the third portion and the second portion is oriented perpendicular to the first portion and the third portion. A dimension of at least one of the first portion and the third portion is related to the operating frequency range.

The present disclosure relates in another embodiment to an antenna system. The antenna system includes a slotted waveguide antenna. The slotted waveguide antenna includes a waveguide configured to enclose a waveguide cavity. The waveguide includes a first surface and a first plurality of slots defined in the first surface. Each slot is configured to transmit and receive electromagnetic waves with frequencies in an operating frequency range. The antenna system further includes the first plurality of metamaterial structures positioned external to the waveguide. Each metamaterial structure is positioned relative to a respective slot and configured to exhibit a negative effective permittivity and a negative effective permeability for the operating frequency range. Each metamaterial structure includes a second plurality of split ring resonators, a substrate and a composite wire structure. Each split ring resonator includes an outer split ring and a concentric inner split ring. The composite wire structure includes a composite first portion, the second plurality of second portions and a composite third portion. The second plurality of second portions is coupled between the composite first portion and the composite second portion. The composite first portion is oriented parallel to the composite third portion. The second portions are oriented perpendicular to the composite first portion and the composite third portion. A dimension of at least one of the composite first portion and the composite third portion is related to the operating frequency range.

DETAILED DESCRIPTION

Figure 1:
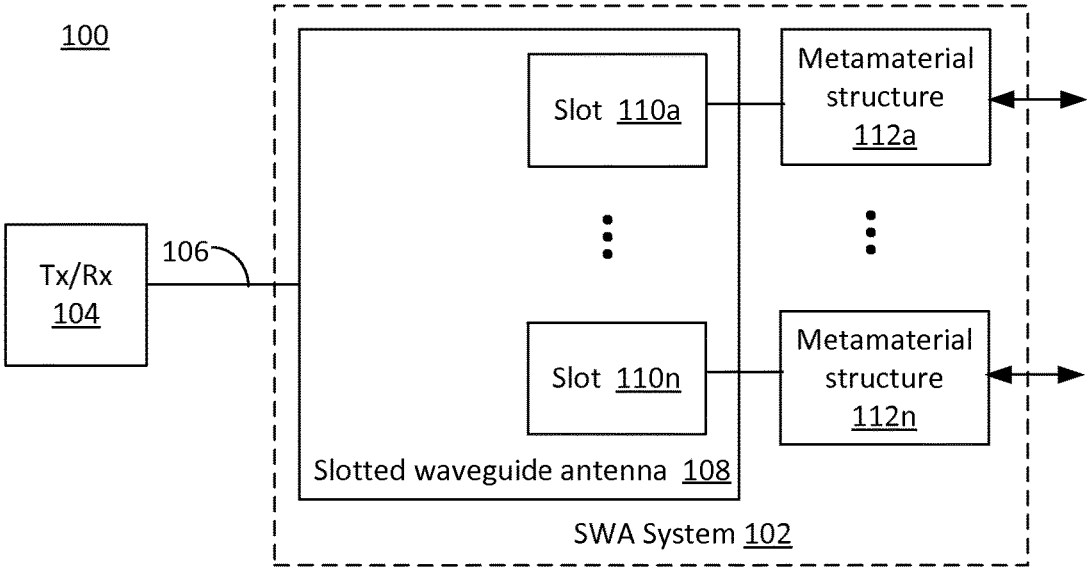
FIG. 1 illustrates a functional block diagram of a system consistent with the present disclosure.

Generally, this disclosure describes a slotted waveguide antenna system and method. The slotted waveguide antenna system includes a slotted waveguide antenna (SWA) and a plurality of metamaterial structures positioned external to the SWA. The metamaterial structures are configured to enhance one or more performance characteristic(s) of the SWA. The performance characteristics include directivity, gain, bandwidth, beamwidth and/or VSWR (voltage standing wave ratio). Thus, performance of the SWA may be enhanced without increasing a size of the SWA and/or the size of the SWA may be decreased while maintaining performance characteristic(s) by the addition of the metamaterial structures.

The SWA includes a rectangular waveguide with a plurality of slots defined in a surface of the SWA. A plurality of metamaterial structures may be positioned external to the SWA, with a respective metamaterial structure positioned relative to each slot. In an embodiment, the metamaterial structures may be oriented parallel to the surface of the SWA. In another embodiment, the metamaterial structures may be oriented perpendicular to the surface of the SWA. As used herein, a parallel orientation corresponds to parallel within a finite tolerance and a perpendicular orientation corresponds to perpendicular within a tolerance. For example, tolerance for a perpendicular orientation may be ±4 degrees and tolerance for a parallel orientation may be ±0.005 inch. Each metamaterial structure may be positioned a distance from the surface of the SWA. Tolerance for this distance may correspond to the tolerance associated with the parallel orientation, i.e., ±0.005. The distance may be selected to enhance the operational characteristics of the SWA.

Metamaterials are structures that are configured to provide a material property that is not naturally present in materials. The material property is based, at least in part, on a physical configuration of the structure. Physical configuration parameters may include, but are not limited to, physical dimension(s), orientation(s), position(s), naturally occurring material propert(ies), relative orientation(s) and/or relative position(s) of one or more element(s) of the metamaterial structure. Material properties that may be provided by a metamaterial include negative permeability and negative permittivity. The metamaterial may be configured to exhibit negative permittivity and negative permeability over a finite frequency band. The finite frequency band has a minimum frequency that corresponds to a cut off frequency and maximum frequency that corresponds to a plasma frequency. The plasma frequency is related to the physical configuration parameters. Thus, physical configuration parameters may be selected to provide a desired plasma frequency (and thereby the maximum frequency of the frequency band).

Metamaterial structures consistent with the present disclosure may each include an array of one or more metamaterial unit cell(s). Each metamaterial unit cell includes a split-ring resonator (SRR) structure, a substrate and a wire structure. Metamaterial structures consistent with the present disclosure are configured to provide a negative effective permeability ($\mu_{eff}$) and a negative effective permittivity ($\in_{eff}$) over an operating frequency range (i.e., band). The plasma frequency is configured to be greater than a maximum operating frequency. For example, the SRR structure may be configured to provide negative $\mu_{eff}$ and the wire structure may be configured to provide negative $\in_{eff}$. Thus, the metamaterial unit cells may be termed double negative metamaterials (DNM) and/or negative index metamaterials (NIM). Metamaterial structures consistent with the present disclosure may then enhance one or more performance characteristics of the SWA over the operating frequency range.

Antenna performance characteristics may include, but are not limited to, directivity, gain, beamwidth, bandwidth and/or voltage standing wave ratio (VSWR). Directivity is a ratio of a maximum radiation intensity from an antenna in a given direction to a radiation intensity averaged over all directions. The average radiation intensity is equal to the total power radiated by the antenna divided by 4π. Gain is a ratio of antenna radiation intensity, in a given direction, to the radiation intensity that would be obtained if the power accepted by the antenna were radiated isotropically. Gain does not include losses that may arise from impedance and polarization mismatches. The radiation intensity corresponding to the isotropically radiated power is equal to the power accepted by the antenna divided by 4π. If an antenna is without dissipative loss, then in any given direction, its gain is equal to its directivity.

Beamwidth corresponds to half-power beamwidth and is, in a radiation pattern cut containing a direction of a maximum of a lobe, an angle between the two directions in which the radiation intensity is one-half the maximum value. Bandwidth corresponds to a range of frequencies within which an antenna performance characteristics satisfies a defined criterion, e.g., gain at or above a value, VSWR at or below a value.

Voltage standing wave ratio (VSWR) is the ratio of an amplitude of a partial standing wave at an antinode (maximum) to the amplitude at an adjacent node (minimum) of a transmission line, e.g., transmission line 106, feeding an antenna, e.g., SWA 108. VSWR is related to a reflection coefficient as VSWR=(1+magnitude of the reflection coefficient)/(1−magnitude of the reflection coefficient. The reflection coefficient is also known as return loss and/or S-parameter $S_{11}$, as described herein.

FIG. 1 illustrates a functional block diagram of a system 100 consistent with various embodiments of the present disclosure. System 100 includes a slotted waveguide antenna (SWA) system 102 coupled to a transmitter and/or receiver Tx/Rx 104 by a transmission line 106. The transmission line 106 may include, for example, a coaxial cable, a twisted pair transmission line and/or waveguide. The Tx/Rx 104 is configured to transmit and/or receive one or more time varying signals, e.g., a voltage and/or a current waveform, to and/or from SWA system 102 via transmission line 106. SWA system 102 is configured to convert a voltage and/or current waveform received from Tx/Rx 104 into a corresponding time varying electromagnetic signal and to transmit the electromagnetic signal out of the SWA system 102. SWA system 102 is further configured to convert a received time varying electromagnetic signal into a corresponding voltage and/or current waveform and to provide the voltage and/or current waveform to Tx/Rx 104. The time varying signals may be characterized by, for example, a center frequency and a bandwidth. The bandwidth may correspond to an operating frequency band, bounded by a maximum operating frequency and a minimum operating frequency. The operating frequency band may be included in a defined frequency band. For example, defined frequency bands may include, but are not limited to, the L band (1 GHz to 2 GHz), S band (2 GHz to 4 GHz), C band (4 GHz to 8 GHz), X band (8 GHz to 12 GHz), Ku band (12 GHz to 18 GHz) and/or K band (18 GHz to 26 GHz). For example, the Tx/Rx 104 may be configured to transmit and/or receive voltage and/or current waveforms and SWA system 102 may be configured to transmit and/or receive corresponding electromagnetic signals with an operating frequency band that is included in the X band.

The SWA system 102 includes a SWA 108 and a plurality of metamaterial structures 112*a*, . . . , 112*n*. The SWA 108 is configured to enclose a waveguide cavity. The SWA 108 includes a plurality of slots 110*a*, . . . , 110*n* defined in a surface of the SWA 108. The surface bounds the waveguide cavity. For example, SWA 108 may correspond to a conventional SWA. Each slot 110*a*, . . . , 110*n* may be generally rectangular shaped and may be positioned in the surface of the SWA 108 a distance $\lambda_g/2$ from an adjacent slot and/or a distance $\lambda_g/4$ from an end of the SWA 108. The distances are measured from centers of the slots. Each slot may be further positioned a respective offset distance from a centerline of the SWA 108. As is known, $\lambda_g$ is a guided wavelength and is related to a cutoff frequency (i.e., wavelength of cutoff frequency) of a waveguide, a width of SWA 108 and a wavelength of an incident electromagnetic wave $\lambda$. For example, SWA 108 may be a standing wave waveguide configured to radiate and/or receive a fundamental mode transverse electric wave ($TE_{10}$). For a cutoff frequency, $f_c$, a corresponding wavelength, $\lambda_c$, and an SWA width, a (long axis of slots parallel to a length dimension, b, of SWA 108), $\lambda_c$=2a and the guided wavelength is $$\lambda_g = \frac{\lambda}{\sqrt{\lambda_c^2 - \lambda^2}}$$

for incident electromagnetic waves with wavelength $\lambda$. The cutoff frequency of SWA 108 may then be related to a minimum operating frequency of Tx/Rx 104.

The transmission line 106 may be coupled to SWA 108. For example, the transmission line 106 may be coupled to the SWA 108 at an end perpendicular to the slotted surface. In another example, the transmission line 106 may be coupled to the SWA 108 at a surface that opposes the slotted surface. In other words, SWA 108 may be end fed and/or center fed.

Each metamaterial structure 112*a*, . . . , 112*n* may be positioned external to the SWA 108, relative to a respective slot 110*a*, . . . , 110*n*. The metamaterial structures 112*a*, . . . , 112*n* are configured to enhance operation of the SWA 108 by enhancing coupling between each slot 112*a*, . . . , 112*n* and a medium in which the SWA 108 is operating, e.g., free space. The metamaterial structures 112*a*, . . . , 112*n* are configured to exhibit negative permeability and negative permittivity over a target frequency range that includes the operating frequency range of system 100 and SWA 108. Physical configuration parameters associated with the metamaterial structures 112*a*, . . . , 112*n* may be selected, determined and/or optimized to achieve DNM characteristics for frequencies within the target frequency range. The metamaterial structures 112*a*, . . . , 112*n* may then be configured to enhance one or more antenna performance characteristics of SWA 108 for time varying signals with frequencies within the target frequency range.

Figure 2A:
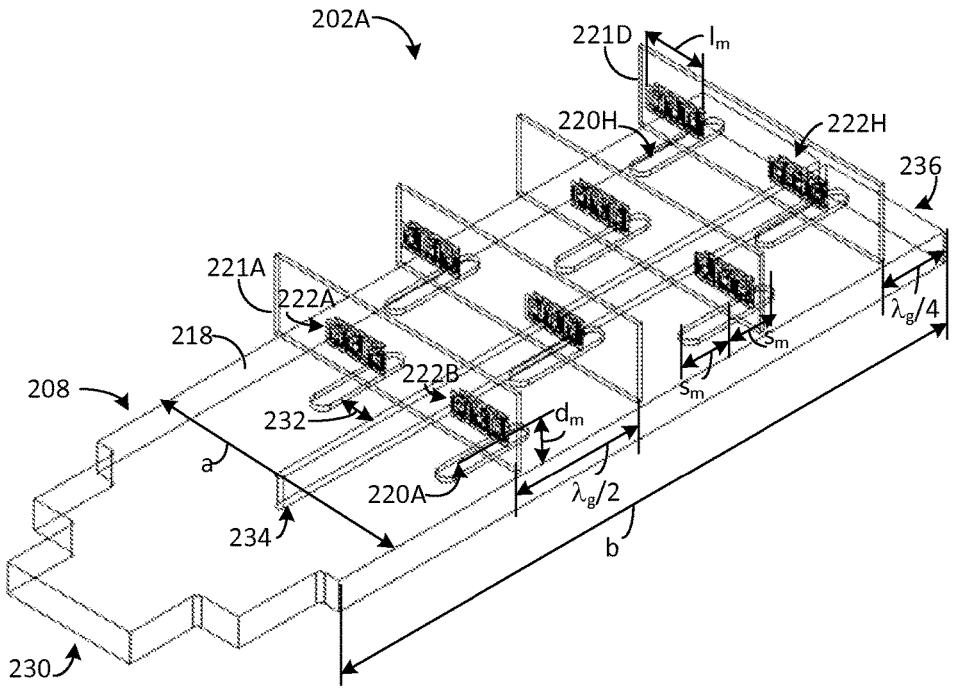
FIGS. 2A and 2B illustrate two example slotted waveguide antenna systems consistent with various embodiments of the present disclosure.
Figure 2B:
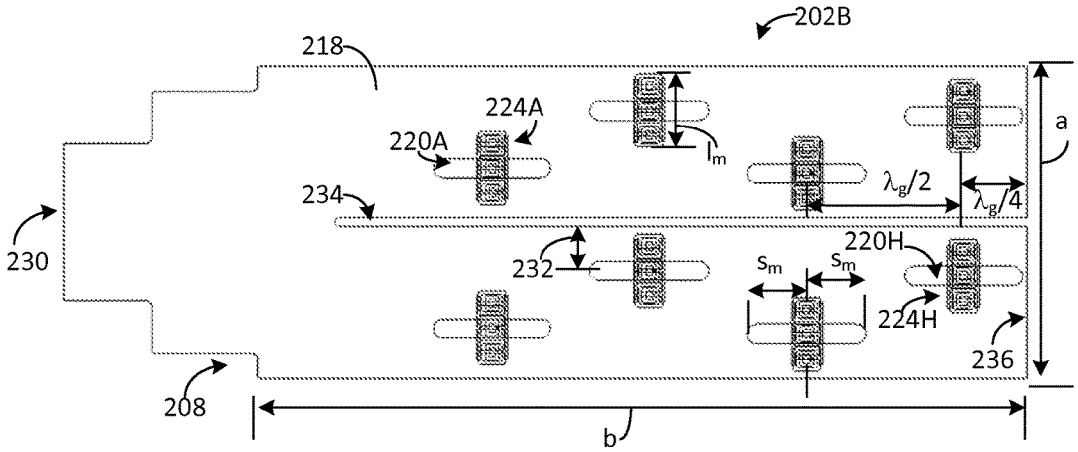

FIGS. 2A and 2B illustrate two example SWA systems 202A, 202B consistent with various embodiments of the present disclosure. The SWA systems 202A, 202B are examples of SWA system 102 of FIG. 1. The SWA systems 202A, 202B each include a SWA 208 that includes a first surface 218 that has a width, a, and a length, b. SWA 208 further includes a first end 230 configured to be coupled to a transmission line (e.g., waveguide) and a second end 236. A plurality of slots are defined in the first surface 218. In these examples 202A, 202B, eight slots 220A, . . . 220H are defined in the first surface 218 of SWA 208. Each slot 220A, . . . 220H has a slot length $2*S_m$ and is positioned a distance $\lambda_g/2$ from an adjacent slot and/or a distance $\lambda_g/4$ from the second end 236. Each slot 220A, . . . 220H is positioned an offset, e.g., offset 232, from a centerline 234 of SWA 208.

SWA system 202A and SWA system 202B each includes a plurality of metamaterial structures 222A, . . . , 222H and 224A, . . . , 224H, respectively, positioned external to SWA 208. The metamaterial structures 222A, . . . , 222H of SWA system 202A are positioned perpendicular to first surface 218. Thus, SWA system 202A may correspond to a "vertical" orientation of metamaterial structure with respect to SWA 208. The metamaterial structures 224A, . . . , 224H of SWA system 202B are positioned parallel to first surface 218. Thus, SWA system 202B may correspond to a "horizontal" orientation of metamaterial structure with respect to SWA 208. In this context, "vertical" and "horizontal" are merely labels configured to differentiate between a first embodiment, e.g., SWA system 202A, and a second embodiment, e.g., SWA system 202B, of an SWA with metamaterial structures, consistent with various embodiments of the present disclosure. The metamaterial structures 222A, . . . , 222H and 224A, . . . , 224H may be positioned and/or oriented so that a long axis dimension, $l_m$, of each metamaterial structure is generally perpendicular to a long axis (e.g., dimension $2*s_m$) of a respective slot. The metamaterial structures 222A, . . . , 222H and 224A, . . . , 224H may be further positioned and/or oriented so that at least a portion of at least one metamaterial unit cell (as described herein) of each metamaterial structure is positioned at or near a center of the respective slot. In other words, each metamaterial structures 222A, . . . , 222H and 224A, . . . , 224H may or may not be centered relative a respective slot in a width direction of the SWA.

A number of metamaterial structures corresponds to the number of slots 220A, . . . , 220H. For example, a SWA system with eight slots may include eight metamaterial structures. In another example, an SWA system with sixteen (or more) slots may include sixteen (or more) metamaterial structures. Each metamaterial structure is positioned a distance, $d_m$, from the first surface 218. In an embodiment, $d_m$ may be adjusted to enhance and/or to facilitate enhancing one or more SWA performance characteristics, as described herein. Each metamaterial structure, is further centered in a length dimension (i.e., long axis) of a respective slot. Thus, for a slot length $2*s_m$, each metamaterial structure may be centered within a tolerance a distance $s_m$ from each end of the slot. For example, the tolerance may be ±0.01.

One or more metamaterial structures 222A, . . . , 222H, may be included in a respective metamaterial structure assembly 221A, . . . , 221D. For example, metamaterial structure assembly 221A includes metamaterial structures 222A and 222B. Metamaterial structure assembl(ies) 221A, . . . , 221D are configured to facilitate mounting metamaterial structures 222A, . . . , 222H to SWA 208. Metamaterial structure assembl(ies) 221A, . . . , 221D may include mounting features configured to facilitate attaching metamaterial structure assembl(ies) (i.e., 221A, . . . , 221D) to SWA 208.

Figure 3B:
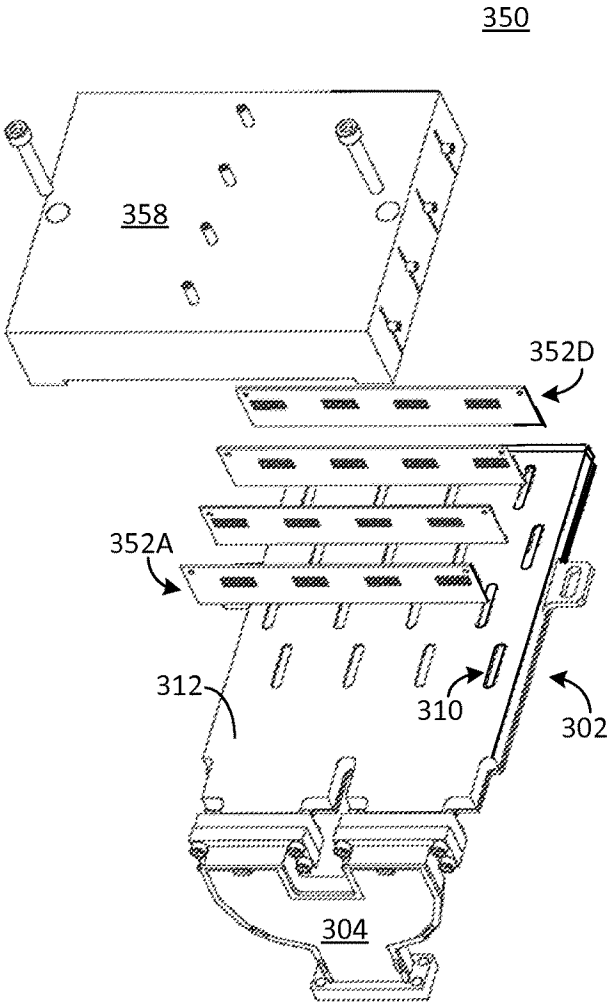
FIGS. 3A and 3B illustrate two example slotted waveguide antenna systems consistent with two embodiments of the present disclosure.
Figure 3A:
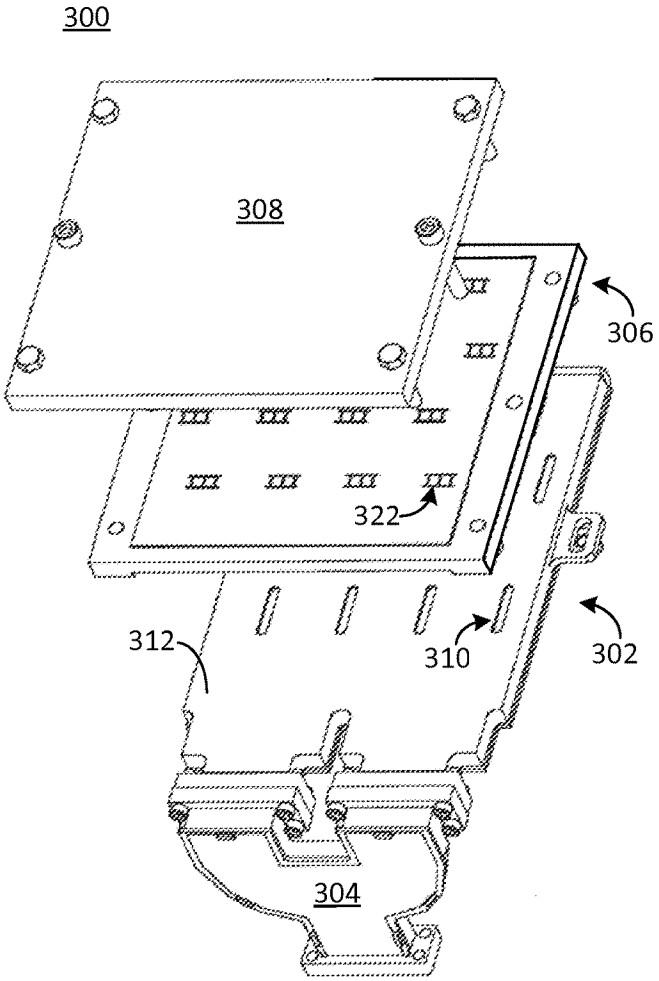

FIGS. 3A and 3B illustrate two example slotted waveguide antenna systems 300, 350 consistent with two embodiments of the present disclosure. SWA system 300 corresponds to a horizontal configuration and SWA system 350 corresponds to a vertical configuration, as described herein. The example SWA systems 300, 350 each include an SWA 302, a feeding waveguide structure 304 and a respective cover 308, 358. SWA 302 includes sixteen slots 310, defined in a first surface 312. SWA system 300 includes an metamaterial structure assembly 306 that includes sixteen metamaterial structures. Composite wire structures 322 are positioned in the metamaterial structure assembly 306 on a surface away from the surface 312 of the SWA 302. Thus, SRR arrays corresponding to the composite wire structures 322 may be facing surface 312. SWA system 350 includes a plurality of metamaterial structure assemblies 352A, . . . , 352D that include sixteen metamaterial structures. In this example, each metamaterial structure assembly 352A, . . . , 352D includes four metamaterial structures.

Thus, a plurality of metamaterial structures may be positioned relative to the plurality of slots, external to a slotted waveguide antenna. In an embodiment, the metamaterial structures may be oriented in parallel with the surface of the SWA that defines the slots. In another embodiment, the metamaterial structures may be oriented perpendicular to the surface of the SWA that defines the slots. The metamaterial structures are configured to enhance one more performance characteristics of the SWA, as described herein.

Figure 4B:
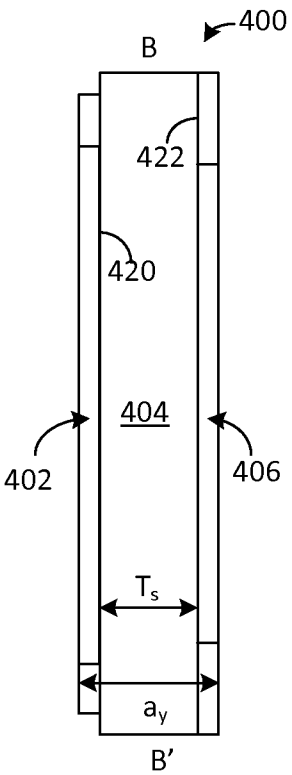
FIGS. 4A and 4B illustrate an example metamaterial unit cell consistent with various embodiments of the present disclosure.
Figure 4A:
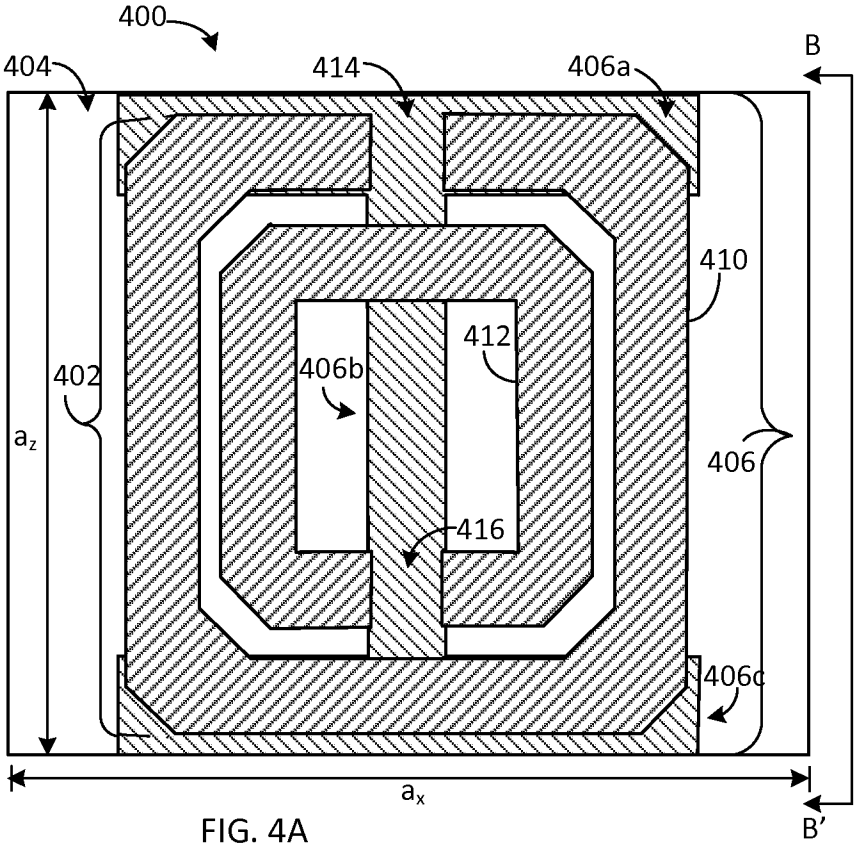

FIGS. 4A and 4B illustrate an example metamaterial unit cell 400 consistent with various embodiments of the present disclosure. FIG. 4A illustrates a front view and FIG. 4B illustrates a side view. A perspective BB' of the side view is illustrated relative to the front view in FIG. 4A. Each metamaterial structure, e.g., metamaterial structures 112*a*, . . . , 112*n* of FIG. 1, may include one or more metamaterial unit cells generally configured similar to metamaterial unit cell 400. For a metamaterial structure that includes a plurality of metamaterial unit cells (i.e., an array of metamaterial unit cells), the metamaterial unit cells may be positioned relative to each other enhance one or more antenna performance characteristics, as described herein. One or more physical dimensions related to a respective metamaterial unit cell of the array of metamaterial unit cells in a metamaterial structure may be adjusted to refine operation of the metamaterial structure, as will be described in more detail below. Thus, a metamaterial unit cell in a metamaterial structure may or may not be identical to each other metamaterial unit cell in the array of metamaterial unit cells. Physical dimensions of each metamaterial unit cell in an array of metamaterial unit cells may be selected, determined and/or refined based, at least in part, on whether the metamaterial structure is configured to be oriented vertically or horizontally with respect to the SWA surface.

Metamaterial unit cell 400 includes a split ring resonator (SRR) 402, a substrate 404 and a wire structure 406. The substrate 404 is positioned between the SRR 402 and the wire structure 406. The metamaterial unit cell 400 and/or substrate 404 may have a width $a_x$ and a length $a_z$. The metamaterial unit cell 400 may further have a thickness $a_y$ that includes a thickness $T_s$ of the substrate and thicknesses of the SRR 402 and wire structure 406. Thus, in an xyz coordinate system, width corresponds to the x direction, length corresponds to the z direction and thickness corresponds to the y direction. It should be noted that definition of the coordinate system is for ease of description. Element(s) of SRR 402, substrate 404 and wire structure 406 are generally planar in the xz plane.

The SRR 402 includes an outer split ring 410 and a concentric inner split ring 412. Each split ring 410, 412 may have a generally rectangular shape. Each split ring 410, 412 includes a conductive portion (e.g., a trace) that defines a respective gap 414, 416 (i.e., a "split"). The gaps 414, 416 may thus not be conductive and may expose a portion of substrate 404. The wire structure 406 includes a first portion 406*a*, a second portion 406*b* and a third portion 406*c*. A long axis of the first portion 406*a* and a long axis of the third portion 406*c* are oriented generally in parallel. The second portion 406*b* is connected to, and positioned between, the first portion 406*a* and the third portion 406*c*. The second portion 406*b* is oriented generally perpendicular to the first portion 406*a* and to the third portion 406*c*. As used herein, generally perpendicular and generally parallel correspond to perpendicular and parallel to within manufacturing tolerances. The splits 414, 416 may be generally aligned with the second portion 406*b* of the wire structure 406. A first portion of the outer split ring 410 that includes gap 414 may overlay the first portion 406*a* of wire structure 406 and a second portion of the outer split ring 410 may overlay the third portion 406*c* of the wire structure 406. The relative positions and dimensions of outer split ring 410 and inner split ring 412 are configured to provide a resonance related to a maximum operating frequency, as described herein. The relative positions and dimensions of wire structure 406 and first second and third portions 406A, 406B, 406C are configured to enhance coupling between SRR 402 and wire structure 406 and are configured to provide a second resonance that may enhance operating bandwidth.

Substrate 404 may correspond to a printed circuit board having a first surface 420 and an opposing second surface 422. The first surface 420 and second surface 422 may be generally planar. SRR 402 may then be formed on the first surface 420 and wire structure 406 may be formed on the opposing second surface 422. In this example, SRR 402 and wire structure 406 may then correspond to conductive traces. For example, the conductive traces may include copper. The substrate 404 may include and/or be formed of a dielectric material that has a relative permittivity (i.e., dielectric constant), $\in_r$, and a loss tangent. For example, substrate 404 may have a relative permittivity (i.e., dielectric constant) of 2.2 and a loss tangent of 0.009.

Nominal physical dimensions of the wire structure 406 and nominal physical dimensions of the SRR 402 may be determined based, at least in part, on a target operating frequency range. Metamaterial structures, as described herein, are configured to exhibit both negative permittivity and negative permeability over a target frequency range that includes an operating frequency range. Metamaterial structures may be considered homogeneous when a maximum physical dimension of the metamaterial structure is less than or equal to $\lambda/10$ where $\lambda$ corresponds to a wavelength of a maximum operating frequency. Wavelength may be determined from $\lambda=v/f$, where $v$ is propagation velocity of an electromagnetic wave in a medium, f is frequency of the electromagnetic wave in cycles/second and $\lambda$ is wavelength in meters. $v$ is related to c, propagation velocity of an electromagnetic wave in a vacuum (i.e., $3\times10^8$ meters/sec), as $v=c/n$ where n a refractive index that depends, at least in part, on material properties (e.g., permittivity and permeability) of the medium. The maximum physical dimension may be utilized with maximum operating frequency in determination of the nominal physical dimensions of the wire structure 406 and/or the SRR 402, as described herein.

Wire structure 406 is configured to provide negative permittivity and SRR 402 is configured to provide negative permeability. Permittivity and/or permeability may be negative for frequencies less than an associated plasma frequency. Thus, physical dimensions of wire structure 406 and SRR 402 may be determined based, at least in part, on an operating frequency range. In other words, one or more physical dimension(s) of wire structure 406 and one or more physical dimension(s) of SRR 402 may be selected and/or optimized so that an associated plasma frequency is greater than or equal to a maximum operating frequency of an associated SWA, e.g., SWA 108. The maximum operating frequency may correspond to a center frequency plus one-half of an operating bandwidth. For example, for a center frequency of 9.5 GHz and an operating bandwidth of 400 megahertz (MHz), the maximum operating frequency may correspond to 9.5+(2*0.4)=9.7 GHz. Continuing with this example, metamaterial unit cell 400 may be configured to provide a plasma frequency of greater than 9.7 GHz. For example, the target plasma frequency may be in a range of about 10 GHz to about 11 GHz. Of course, wire structure 406 may be configured with other physical dimensions to provide a different maximum operating frequency associated with a different operational frequency range.

Figure 5A:
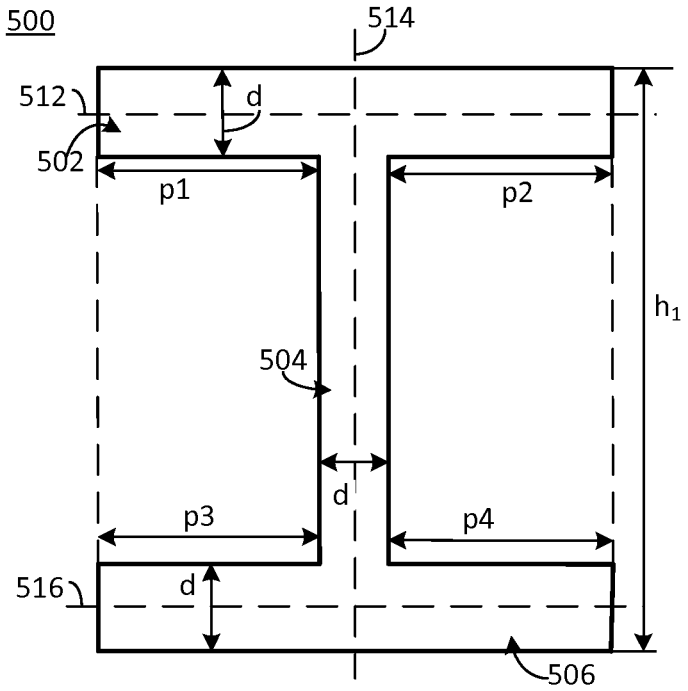
FIGS. 5A and 5B illustrate an example wire structure and an example split ring resonator, respectively, according to at least one embodiment of the present disclosure.
Figure 5B:
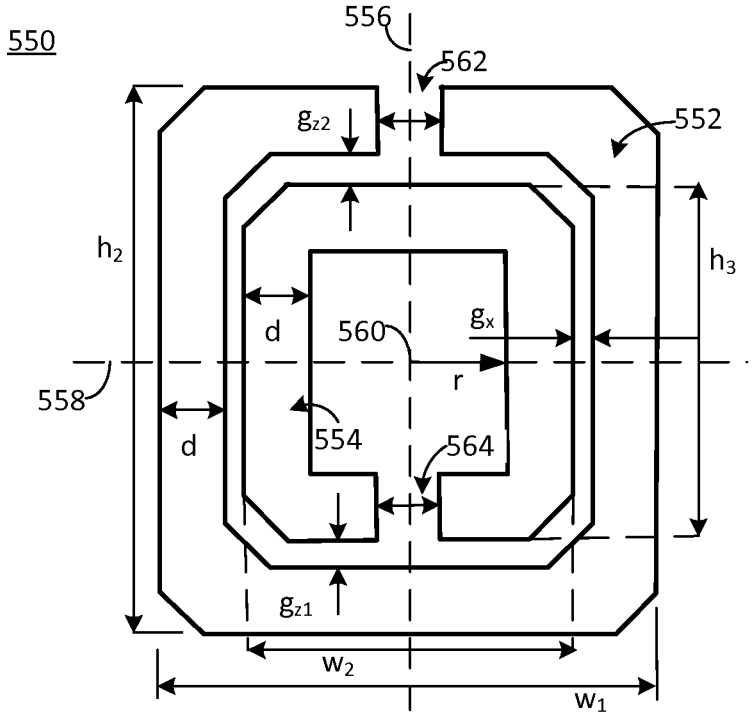

FIGS. 5A and 5B illustrate an example wire structure 500 and an example SRR 550, respectively, according to at least one embodiment of the present disclosure. Wire structure 500 is an example of wire structure 406 and SRR 550 is an example of SRR 402 of FIGS. 4A and 4B. Turning now to FIG. 5A, wire structure 500 includes a first portion 502, a second portion 504 and a third portion 506. Similar to wire structure 406, a long axis 512 of the first portion 502 and a long axis 516 of the third portion 506 are oriented generally in parallel, for example, parallel to an x-axis. The second portion 504 is connected to, and positioned between, the first portion 502 and the third portion 506. The second portion 504 is oriented generally perpendicular to the first portion 502 and to the third portion 506 and is parallel to a z axis. An xyz coordinate system of FIGS. 5A and 5B corresponds to the xyz coordinate system of FIGS. 4A and 4B.

Each wire structure portion 502, 504, 506 may have a conductor width, d. For example, the conductor width d may correspond to trace width of a printed circuit board trace. A length of the first portion 502 corresponds $d+p_1+p_2$ where $p_1$ is a length of the first portion 502 on a first side (e.g., −x direction) of the first portion 502 and $p_2$ is a length of the first portion 502 on a second side (e.g. +x direction) of the first portion 502. At least one of $p_1$ and $p_2$ is greater than zero. Similarly, a length of the third portion 506 corresponds to $d+p_3+p_4$. At least one of $p_3$ and $p_4$ is greater than zero. $p_1$, $p_2$, $p_3$ and/or $p_4$ may or may not be a same length. A distance, p, between adjacent wire structures in a metamaterial structure that includes an array of metamaterial unit cells may correspond to a distance between respective second portions 504 of the adjacent wire structures. The distance may be related to one or more of $p_1$, $p_2$, $p_3$ and $p_4$. Length(s) of $p_1$, $p_2$, $p_3$ and/or $p_4$ may vary between metamaterial unit cells in a metamaterial structure that includes an array of metamaterial unit cells.

Effective permittivity $\in_{eff}$ may be defined (based, e.g., on a Drude polarization model) as:

$$\varepsilon_{eff} = 1 - \frac{\omega_p^2}{\omega^2 + j\omega\zeta}$$

where $\omega_p$ is the plasma frequency in radians per second, ω is a propagation frequency in radians per second, j is the square root of minus one, ζ is damping coefficient and ω=2πf. The real part of $\in_{eff}$ is negative when $\omega^2<\omega_p^2-\zeta^2$. The plasma frequency may be defined as:

$$\omega_p = \sqrt{\frac{2\pi c^2}{p^2 \ln\left(\frac{p}{d}\right)}}$$

where c is propagation velocity of an electromagnetic wave in a vacuum (i.e., $3\times10^8$ meters/sec), p is the distance between the second portion of respective wire structures in two adjacent metamaterial unit cells and d is trace width. Thus, the plasma frequency may be related to physical dimensions of wire structure 500. The plasma frequency for wave propagation in a dielectric medium, e.g., substrate 404 of FIGS. 4A and 4B, may depend on a relative permittivity $\in_r$ (i.e., dielectric constant of the medium). To include the effects of the medium, the plasma frequency equation may be modified to include the relative permittivity of the medium by including $\in_r$ as a multiplier of the denominator under the radical. The plasma frequency may then include contributions from the dielectric medium. The plasma frequency is the frequency at which the effective permittivity of a metamaterial changes from negative to positive. In other words, effective permittivity is negative for frequencies less than the plasma frequency. The damping coefficient, ζ, may be determined as:

$$\zeta = \frac{\varepsilon_0\left(\frac{d\omega_p}{p}\right)^2}{\pi\sigma}$$

where σ is the conductivity of a wire structure material (e.g., for metal, σ=0.5), p is the distance between second portions of respective wire structures of two adjacent metamaterial unit cells and d is trace width of the wire structure trace.

Trace width, d, and length parameters related to the first portion 502 and to the third portion 506 (i.e., $p_1$, $p_2$, $p_3$, $p_4$) may be selected and/or determined based, at least in part, on a maximum operating frequency. Setting $\omega^2$ equal to $\Omega_p^2-\zeta^2$, substituting the equations for plasma frequency and damping coefficient above and setting co equal to a maximum operating frequency plus a margin (e.g., ten percent) yields one equation with two unknowns (p, d) that includes the unknowns raised to powers greater than one and a natural logarithm of a ratio of the unknowns. The distance between adjacent wire structure second portions, p, may be further constrained based on wavelength of the maximum operating frequency plus the margin as p<=λ/10 where λ corresponds to the wavelength of the maximum operating frequency plus the margin. A numerical computation utility may then be utilized to determine value pairs of d and p that satisfy the constraints. For example, MathWorks® MATLAB® numerical computation software, available from Math- Works®, Natick, Mass., may be utilized to parameterize $\Omega^2=\omega_p-\zeta^2$ to optimize values for d and p. $p_1$, $p_2$, $p_3$, $p_4$ may then be related to p. For example, each $p_1$, $p_2$, $p_3$, $p_4$ may be initially set to p/2. $p_1$, $p_2$, $p_3$, $p_4$, may be further adjusted to refine operational characteristics of a metamaterial structure that includes an array of metamaterial unit cells, as described in more detail below.

Thus, wire structure 500 may be configured to provide negative relative permittivity for frequencies at or below a maximum operating frequency by selection, determination and/or optimization of trace width, d, and distance, p, between second portions of respective adjacent wire structure in a metamaterial structure that includes an array of wire structures.

Turning now to FIG. 5B, SRR 550 includes an outer split ring 552 and a concentric inner split ring 554. Each split ring 552, 554 has a generally rectangular shape and may be formed of a conductive material, e.g., may be a conductive trace. Outer corners of each split ring 552, 554 may be removed and each inner corner of the outer ring 552 may be filled with conductive material to provide a relatively smaller discontinuity at the corners. Width and length dimensions described herein are defined away from the corners. Width dimensions are generally defined parallel to an x-axis and length dimensions are defined generally parallel to a z-axis consistent with the descriptions associated with FIGS. 4A and 5A. Each split ring 552, 554 includes a conductive portion that defines a respective gap 562, 564 (i.e., a "split"). Each split ring 552, 554 conductor has a nominal width, d. A z centerline 556 may be defined parallel to a z axis. The z centerline 556 may be centered in gaps 562, 564. An x centerline 558 may be defined parallel to an x axis. The z and x centerlines 556 and 558 are mutually perpendicular and cross at a geometric center of SRR 550 (i.e., center point 560). A distance, p, between adjacent SRRs in an array of SRRs may be measured between center points, e.g., center point 560.

Inner split ring 554 has a width $w_2$ and a length $h_3$ and outer split ring 552 has a width $w_1$ and a length $h_2$. An inner edge of inner split ring 554 defines an area that has width 2*r. The inner split ring 554 may be separated from the outer split ring 552 by one or more gaps. The gaps may be measured between an inner edge of outer split ring 552 and an outer edge of inner split ring 554. A first gap has a length $g_{z1}$ measured relatively near the slit 564. A second gap has a length $g_{z2}$ measured relatively near the slit 562. A third gap has a width $g_x$ measured relatively near the x centerline 558.

One or more of the various physical dimensions may be selected, adjusted and/or optimized to achieve a negative effective permeability for frequencies below a magnetic plasma frequency associated with SRR 550. Similar to the operations associated with determining nominal physical dimensions of wire structure 500 to achieve negative permittivity over the operating frequency range, nominal physical dimensions of SRR 550 may be selected, adjusted and/or optimized to achieve negative permeability.

Effective permeability $\mu_{eff}$ may be defined as:

$$\mu_{eff} = 1 - \frac{\omega^2\left[\pi\left(\frac{r}{d}\right)^2\right]}{\omega^2 - \omega_{mrf}^2 + j\omega\zeta}$$

where ω is the propagating frequency of the electromagnetic wave, $\omega_{mrf}$ is the magnetic resonant frequency of the SRR 550, r is a distance from the center point 560 to an inner edge of the inner ring 554 (i.e., one half the width defined by the inner edge of the inner ring 554), p is the distance between center points of adjacent SRRs in an array of SRRs and d is width of the conductors that form the split rings 552, 554. ζ is a damping factor due to resistive losses in the conductors (e.g., conductive traces) that form the inner split ring 552 and the outer split ring 554. The damping factor may be determined as ζ=2*d*R, where R is resistivity of split ring conductor material (e.g., copper) per unit length.

The magnetic resonant frequency may be determined as:

$$\omega_{mrf} = c\sqrt{\frac{3d}{\pi r^3 \ln\left(\frac{2p}{g}\right)}}$$

where c is propagation velocity of an electromagnetic wave in a vacuum, g is the gap between the inner and outer split rings 554, 552. It may be assumed that $g=g_x=g_{z1}=g_{z2}$ for this initial determination. $\omega_{mpf}$, a magnetic plasma frequency, may be defined as:

$$\omega_{mpf} = \frac{\omega_{mrf}}{\sqrt{1-\pi\left(\frac{r}{d}\right)^2}}$$

Similar to the relationship between effective permittivity and $\omega_p$, effective permeability is negative for frequencies below the magnetic plasma frequency. In other words, the magnetic plasma frequency is the frequency where the effective permeability changes sign. The equations for $\omega_{mpf}$ and $\omega_{mrf}$ may be modified to include relative permittivity to account for wave propagation in a dielectric medium e.g., substrate 404 of FIGS. 4A and 4B. For example, relative permittivity may be included as a multiplicative factor in the denominator of the equation for $\omega_{mrf}$. The magnetic plasma frequency may then include contributions from the dielectric medium.

$\mu_{eff}$ may be negative when $\omega_{mrf}<\omega<\omega_{mpf}$. Thus, for SRR 550, the operating frequency range includes an upper bound defined by the magnetic plasma frequency and a lower bound defined by the magnetic resonant frequency. Further, the magnetic resonant frequency and the magnetic plasma frequency are not independent.

Conductor (e.g., trace) width, d, and physical dimensions of outer split ring and inner split ring, e.g., split rings 552 554, may be determined based, at least in part, on a maximum operating frequency and a minimum operating frequency of the operating frequency range of an associated SWA. A target magnetic plasma frequency may be selected that is greater than the maximum operating frequency. Initial values may be selected for width $w_1$ and length $h_2$ based, at least in part, on the maximum operating frequency. For example, initial values of $w_1$ and/or $h_2$ may be selected to be less than or equal to λ/10, where λ corresponds to the wavelength of the maximum operating frequency in air. These initial values for $w_1$ and/or $h_2$ may then be related to r, g, p and/or d by the geometry of SRR 550, thus providing additional constraints. For example, p may be constrained as p>2(r+g+2*d), corresponding to the distance between the center points of two adjacent SRRs. An initial dimension for trace width, d, e.g., 0.010 inch, may be selected. A numerical computation utility, e.g., MathWorks® MATLAB® may then be utilized to determine values of d, r, g and p that yield a negative effective permeability over at least the operating frequency band. For example, MathWorks® MATLAB® numerical computation software may be utilized to parameterize $\omega_{mpf}$ and $\omega_{mrf}$ to optimize values for r, d, p and g. The optimized values for r, d, p and g are configured to satisfy $\omega_{mrf}$<a minimum operating frequency and $\omega_{mpf}$>a maximum operating frequency for an SRR with maximum dimension less than $\lambda/10$ for the maximum operating frequency. The optimized values for r, d, p and g may be further adjusted to refine operational characteristics of a metamaterial structure that includes an array of metamaterial unit cells, as described in more detail below. Thus, SRR 550 may be configured to provide negative relative permeability over an operating frequency range by selection, determination and/or optimization of physical dimensions r, d, p and g.

Thus, based, at least in part, on a maximum operating frequency, a plasma frequency and a magnetic plasma frequency may be selected and nominal physical dimensions of a wire structure and an SRR of a metamaterial unit cell may be selected, determined and/or optimized. The nominal dimensions of the metamaterial unit cells and/or the metamaterial structure that includes the array of metamaterial unit cells may then be refined to enhance performance of an associated SWA, as described in more detail below.

Figure 6A:
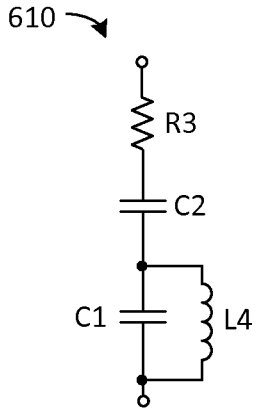
FIGS. 6A, 6B and 6C illustrate lumped element models for an SRR, a wire structure and a metamaterial unit cell, respectively, consistent with various embodiments of the present disclosure.
Figure 6B:
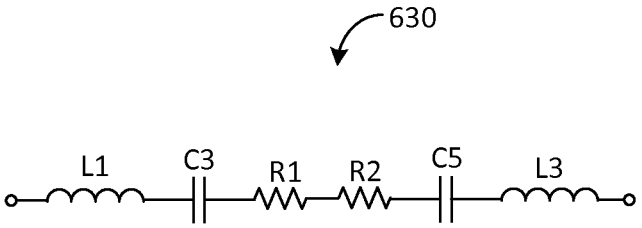
Figure 6C:
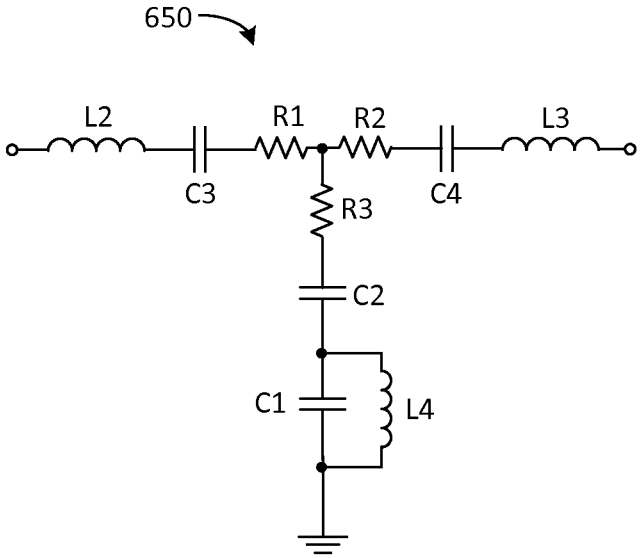

FIGS. 6A, 6B and 6C illustrate lumped element models 610, 630, 650, for an SRR, a wire structure and a metamaterial unit cell, respectively, consistent with various embodiments of the present disclosure. Circuit simulations associated with the lumped element models 610, 630, 650, in combination with electromagnetic field simulations associated with simulated metamaterial unit cell(s) and/or metamaterial structure(s), may be utilized to further refine physical configuration parameters of wire structure 500 and SRR 550 to optimize performance of an SWA system, e.g., SWA system 102 of FIG. 1. A circuit simulation utility may be used to perform operations associated with circuit simulations. An electromagnetic field simulation utility may be used to perform operations associated with electromagnetic field simulations.

Simulation parameters may include, for example, one or more S-parameter(s) (i.e., scatter parameters, scatter coefficients) and or a resonant frequency related to the SWA. For example, a target resonant frequency of a metamaterial structure may correspond to the resonant frequency of each slot in SWA 108. S-parameters provide an input-output relationship between ports in an electrical system and facilitate a "black box" approach to the electrical system. In other words, S-parameters facilitate characterizing the electrical system based on the input-output relationships. For example, for an antenna, S-parameter $S_{11}$ represents an amount of power reflected from the antenna relative to an amount of power provided to the antenna and corresponds to return loss (also known as reflection coefficient). A minimum return loss corresponds to a maximum power delivered to the antenna. The power delivered to the antenna may then be radiated and/or absorbed by losses within the antenna. S-parameter $S_{21}$ represent power transferred from a first port to a second port. For example, $S_{21}$ may correspond to power received at a second antenna relative to power input to a first antenna. Thus, $S_{21}$, also known as forward loss, may include transmission losses.

The circuit simulation utility may be utilized to adjust lumped element values (e.g., corresponding to lumped element models 610, 630, 650) to achieve a target resonant frequency. The circuit simulation utility may be configured to adjust lumped element values based, at least in part, on one or more S-parameter values received from, e.g., the electromagnetic field simulation utility. For example, Genesys RF and Microwave Design Software, available from Agilent Technologies, Inc., Santa Clara, Calif., may be utilized to perform circuit simulations of the lumped element models 610, 630, 650.

The electromagnetic field simulation utility may be utilized to adjust one or more physical configuration parameter(s), e.g., trace width and/or gap spacing, to achieve a target resonant frequency. For example, the electromagnetic field simulation utility may allow parameterizing one or more physical configuration parameter(s) in order to achieve the target resonant frequency. The electromagnetic field simulation utility may be configured to provide one or more S-parameters related to one or more physical configuration parameters. For example, ANSYS® HFSS™, available from ANSYS®, Inc., Canonsburg, Pa., may be utilized to perform electromagnetic field simulations, as described herein.

The lumped element models 610, 630, 650 correspond to lumped element transmission line models of wire structure 500, SRR 550 and a metamaterial unit cell, respectively. The metamaterial unit cell, e.g., metamaterial unit cell 400 of FIGS. 4A and 4B, includes a wire structure, a substrate and an SRR. Thus, elements in the lumped element models 610, 630, 650 are related to physical configuration parameters of the wire structure, SRR and metamaterial unit cell. Values associated with the lumped elements may be adjusted based, at least in part, on electromagnetic field simulation results. The physical configuration of the wire structure, SRR and metamaterial unit cell used for the electromagnetic field simulation may then be adjusted based, at least in part, on the adjusted lumped element values. The electromagnetic field simulation results may be generated based, at least in part, on the physical configuration of the wire structure, SRR and metamaterial unit cell, including the respective physical configuration parameters. The adjustments and simulations may be repeated until one or more simulation parameters converge. The metamaterial unit cell physical configuration associated with the converged simulation parameters may then be utilized as an initial metamaterial unit cell configuration in a metamaterial structure that includes an array of metamaterial unit cells. The metamaterial structure may then be simulated (e.g., electromagnetic field simulation) for further optimization alone and/or positioned relative to a slot of an SWA, as described herein.

Turning to FIG. 6A, lumped element model 610 corresponds to, for example, SRR 550 of FIG. 5B. Lumped element model 610 includes a first capacitor C1 in series with a second capacitor C2 in series with a resistor R3. The lumped element model 610 further includes an inductor L4 coupled in parallel with the first capacitor C1. The capacitances of capacitors C1, C2 are related to slits and/or gaps between the inner split ring and the outer split ring of an SRR. The inductance of inductor L4 corresponds to inductance of the conductors. The resistor R3 represents resistive loss of the SRR structure. Lumped element model 610 may exhibit one or more resonances. For example, for C1 with a capacitance of 1.1 picofarads (pF), C2 with a capacitance of 0.23 pF, R3 with a resistance of 1 ohm (Ω) and L4 with an inductance of 0.252 nano-henries (nH), the lumped element model exhibits two resonances. A first resonance corresponds to a magnetic resonant frequency at 9.57 GHz and a second resonance corresponds to a transmission peak at 8.69 GHz. In this example, the element values of lumped element model 610 were optimized until S-parameters (e.g., S-parameters $S_{ii}$ and $S_{21}$) output from the electromagnetic field simulation utility matched, to within a tolerance, the S-parameters output from the circuit simulation utility.

Turning to FIG. 6B, lumped element model 630 corresponds to, for example, wire structure 500 of FIG. 5A. Lumped element model 630 includes two inductors L1, L3, two capacitors C3, C5 and two resistors R1, R2, all connected in series. The capacitances of capacitors C3 and C5 and the inductances of inductors L1 and L3 are related to the first, second and third portions 502, 504, 506 of the wire structure 500. The resistors R1 and R3 represents resistive losses associated with the wire structure 500. Lumped element model 630 may exhibit a resonance related to the inductances and capacitances. For example, for R1 and R2 each with a resistances of 0.5Ω, C3 with a capacitance of 0.036 pF, C5 with a capacitance of 1.5 pF, L1 with an inductance of 7 nH and L3 with an inductance of 1 nH, lumped element model 630 exhibits a resonance at or near 9.57 GHz for return loss (i.e., S-parameter $S_{11}$). In comparison, the electromagnetic field simulation utility provided a resonance frequency of 9.50 GHz for this example.

Turning to FIG. 6C, lumped element model 650 corresponds to, for example, metamaterial unit cell 400 of FIGS. 4A and 4B, and may include, for example, wires structure 500, a substrate and SRR 550. Lumped element model 650 includes two inductors L2, L3, two capacitors C3, C4 and two resistors R1, R2, all connected in series. These lumped elements are related to the lumped elements of lumped element model 630. A number and configuration of the lumped elements (i.e., L2, L3, C3, C4, R1, R2) correspond to lumped element model 630. Initially, the element values may be the same as lumped element model 630 but may be further optimized to include coupling effects associated combining the wire structure, e.g., wire structure 406, with an SRR, e.g., SRR 402 and a substrate, e.g., substrate 404.

Lumped element model 650 further includes a resistor R3 coupled to a node that is also coupled to R1 and R2. Resistor R3 is further coupled in series to capacitor C2 and capacitor C2 is coupled in series to a parallel combination of C1 and L4. The lumped elements R3, C2, C1 and L4 correspond to lumped element model 610. Initially, the element values of R3, C2, C1 and L4 may be the same as lumped element model 610 but may be further optimized to include coupling effects associated combining the SRR with a wire structure and a substrate. Lumped element model 650 may exhibit one or more resonances related to the inductances and capacitances. For example, for R1, R2 and R3 each with a resistances of 1.0Ω, C1 with a capacitance of 1.125 pF, C2 with a capacitance of 0.32 pF, C3 with a capacitance of 0.035 pF, C4 with a capacitance of 0.5 pF, L2 with an inductance of 7 nH, L3 with an inductance of 1 nH and L4 with an inductance of 0.248 nH, lumped element model 650 exhibits two resonances. A first resonance frequency at about 8.4 GHz and a second resonant frequency at about 9.5 GHz.

Thus, a combination of a lumped element model, a circuit simulation utility, a simulated wire structure, SRR and/or metamaterial unit cell structure and an electromagnetic field simulation utility may be utilized to optimize physical configuration parameters of a metamaterial unit cell, consistent with the present disclosure. The individual metamaterial unit cell may then be combined into an array of metamaterial unit cells to form a metamaterial structure, as described herein.

Figure 7:
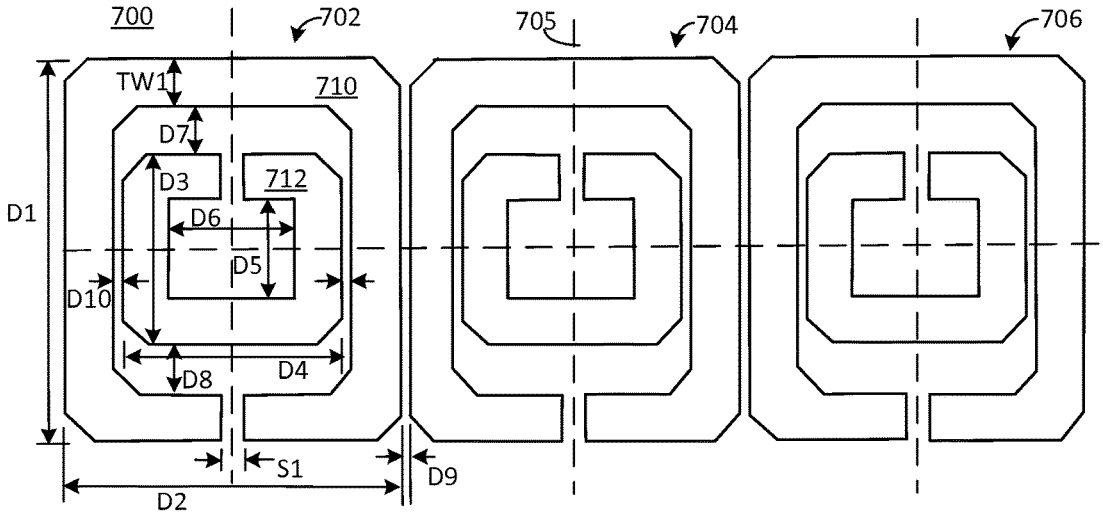
FIG. 7 illustrates an example split ring resonator array consistent with one embodiment of the present disclosure.

FIG. 7 illustrates an example SRR array 700 consistent with one embodiment of the present disclosure. The SRR array 700 includes three SRRs 702, 704, 706. Three SRRs have been selected for this example, based, at least in part, simulations and/or operations associated with selecting, determining and/or optimizing physical configuration parameters. Further, for the example SWA systems 202A, 202B illustrated in FIGS. 2A and 2B, SRR array 700 is configured to provide a substantially optimum far-field radiation pattern and relatively improved SWA performance. It is contemplated that the improved performance may be related to a matching condition between a metamaterial structure that includes SRR array 700 and a respective slot in, e.g., SWA 208. Including additional SRRs in the SRR array 700 may result in mutual coupling between the SRRs and associated distortion of far-field plots.

In this example, the three SRRs 702, 704, 706 are configured to be identical to within a manufacturing tolerance. For example, for a conductive portions formed on a printed circuit board substrate, manufacturing tolerance is ±0.001 inch. Thus, a description and/or dimensions of SRR 702 may apply to SRRs 704 and 706. For ease of description, a width corresponds to a dimension parallel to an x-axis and a length corresponds to a dimension parallel to a z-axis. SRR 702 includes an outer split ring 710 and an inner split ring 712. Inner split ring 712 is positioned in a region substantially circumscribed by outer split ring 710. Outer split ring 710 has a length D1 and a width D2. Inner split ring 712 has a length D3 and a width D4. Inner split ring 710 defines a substantially rectangular region that has a length D5 and a width D6. An upper gap (i.e., a length) between an outer edge of inner split ring 712 and an inner edge of outer split ring 710 has length D7. A lower gap (i.e., a length) between an outer edge of inner split ring 712 and an inner edge of outer split ring 710 has length D8. A gap (i.e., a width) between SRR 702 and SRR 704 has a width D9. A side gap (i.e., a width) between an outer edge of inner split ring 712 and an inner edge of outer split ring 710 has width D10.

In this example 700, a trace width of the inner split ring 712 corresponds to a trace width of the outer split ring 710 and has a dimension TW1. In this example SRR array 700, a width of a split defined by inner split ring 712 corresponds to a width of a split defined by outer split ring 710 and both have a width S1. In other configurations, TW1 and/or S1 may not be the same for both the inner split ring 712 and the outer split ring 710. In this example SRR array 700, the split defined by inner split ring 712 and the split defined by outer split ring 710 are positioned on opposite sides of a centerline parallel to the x-axis.

Figure 8:
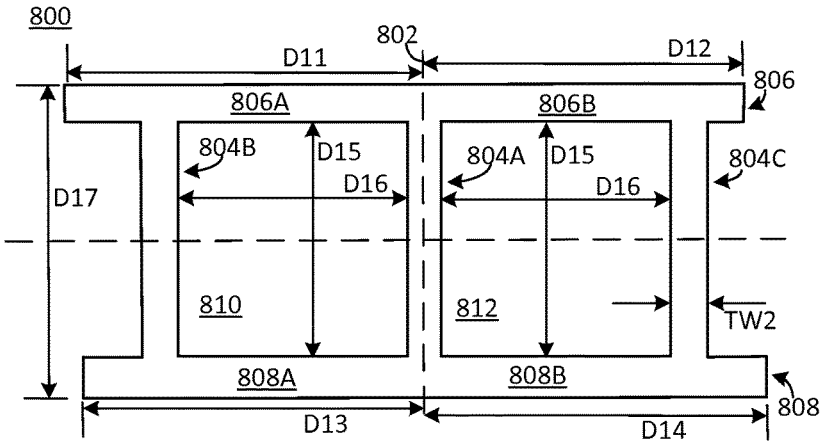
FIG. 8 illustrates an example composite wire structure that includes a plurality of unit cell wire structures coupled together.

FIG. 8 illustrates an example composite wire structure 800 that includes a plurality of unit cell wire structures coupled together, consistent with one embodiment of the present disclosure. The composite wire structure 800 corresponds to a metamaterial structure that includes an array of three metamaterial unit cells, as described herein. In this example, a respective wire structure for each metamaterial unit cell in the metamaterial structure may not be identical so that respective dimensions of, for example, a unit cell wire structure first portion and a unit cell wire structure third portion may vary between the wire structure unit cells in the composite wire structure 800. The dimensions of composite wire structure 800 have been selected, determined and/or optimized based, at least in part, on a target operational frequency range and a nominal unit cell wire structure (e.g., 9.5 GHz±400 MHz), as described herein. Composite wire structure 800 has been further optimized, resulting in, for example, asymmetry. For example, for SWA system 202A, 202B illustrated in FIGS. 2A and 2B, asymmetry in the first portions and third portions may provide relatively better coupling to a slot compared to a metamaterial structure that includes identical (i.e., symmetric) metamaterial unit cell wire structures.

Composite wire structure 800 includes a plurality of unit cell second portions 804A, 804B, 804C that are coupled between a composite first portion 806 and a composite second portion 808. Centerline 802 corresponds to a centerline of the second portion 804A of a unit cell wire structure positioned between adjacent unit cell wire structures. The composite first portion 806 includes a first segment 806A that has width D11 and a second segment 806B that has width D12. The composite second portion 808 includes third segment 808A that has width D13 and fourth segment 808B that has width D14. Widths D11, D12, D13, D14 are measured from the centerline 802. Each of the unit cell second portions 804A, 804B, 804C has a length D15 measured between the composite first portion 806 and the composite second portion 808.

The first segment 806A, third segment 808A and second portions 804A and 804B define a first generally rectangular region 810 that has width D16 and length D15. The second segment 806B, fourth segment 808B and second portions 804A and 804C define a second generally rectangular 812 region that has width D16 and length D15. In this example, the first and second generally rectangular regions 810, 812 have a same width D16, to within a manufacturing tolerance. In some embodiments, the first and second rectangular regions 810, 812 may have unequal width dimensions. In this example, each unit cell second portion 804A, 804B, 804C, composite first portion 806 and composite third portion 808 has a trace width of TW2. In some embodiments, trace width(s) of one or more of unit cell second portion(s) 804A, 804B, 804C, composite first portion 806 and composite third portion 808 may not be the same.

Composite wire structure 800 may be combined with SRR array 700 and a substrate to form a metamaterial structure. For example, SRR array 700 may be formed on a first surface of the substrate and wire structure 800 may be formed on an opposing second surface of the substrate. In this example, a centerline 705 of SRR array 700 may be aligned with the centerline 802 of wire structure 800. The centerline 705 of SRR array 700 may thus correspond to a centerline of the metamaterial structure that includes SRR array 700. Centerline 705 of SRR array 700 corresponds to a centerline of SRR 704. In some embodiments, in part because of asymmetry associated with wire structure 800, centerlines of, for example, SRR 702 and SRR 706 may not align with the respective unit cell second portions 804B, 804C.

Tables 1 and 2 include dimensions of SRR Array 700 and composite wire structure 800 assembled into metamaterial structures that were simulated and prototyped. The substrate was RT/Duroid® 5880 available from Rogers Corporation, Chandler, Ariz., that has a dielectric constant of 2.2 for frequencies between 8 GHz and 40 GHz and a loss tangent of 0.0009. Substrate thickness was 0.031 inch. Of course, other substrate materials may be used that have a similar thickness and a similar dielectric constant and loss tangent for a target operating frequency range. Table 1 includes the dimensions of SRR array 700 for a metamaterial structure oriented perpendicular ("vertical") to a slotted surface of a SWA (e.g., SWA system 202A of FIG. 2A) and for a metamaterial structure oriented parallel ("horizontal") to the slotted surface of the SWA (e.g., SWA system 202B of FIG. 2B). The dimensions of SRR array 700 have been selected, determined and/or optimized based, at least in part, on a target operational frequency range 9.5 GHz±400 MHz, as described herein. The dimensions correspond to prototypes constructed and tested that yielded test data, as described herein. It may be appreciated that tolerances on the dimensions for SRR array 700 are generally within ±0.001 inch (e.g., manufacturing tolerance) for the perpendicular and the parallel orientation.

TABLE 1

| Dimension | Horizontal | Vertical |
|---|---|---|
| D1 | 0.156 | 0.157 |
| D2 | 0.136 | 0.138 |
| D3 | 0.080 | 0.078 |
| D4 | 0.089 | 0.090 |
| D5 | 0.042 | 0.038 |
| D6 | 0.051 | 0.050 |
| D7 | 0.019 | 0.020 |
| D8 | 0.019 | 0.020 |
| D9 | 0.005 | 0.003 |
| D10 | 0.005 | 0.004 |
| TW1 | 0.019 | 0.020 |
| S1 | 0.010 | 0.010 |

Table 2 includes the dimensions of composite wire structure 800 for a metamaterial structure oriented perpendicular ("vertical") to a slotted surface of a SWA (e.g., SWA system 202A of FIG. 2A) and for a metamaterial structure oriented parallel ("horizontal") to the slotted surface of the SWA (e.g., SWA system 202B of FIG. 2B). The dimensions of composite wire structure 800 have been selected, determined and/or optimized based, at least in part, on a target operational frequency range, e.g., 9.5 GHz center frequency and 400 MHz bandwidth, as described herein. It may be appreciated that tolerances on the dimensions for composite wire structure 800 are generally within ±0.001 inch (e.g., manufacturing tolerance) for the perpendicular and the parallel orientation.

TABLE 2

| Dimension | Horizontal | Vertical |
|---|---|---|
| D11 | 0.180 | 0.190 |
| D12 | 0.180 | 0.170 |
| D13 | 0.175 | 0.180 |
| D14 | 0.185 | 0.180 |
| D15 | 0.136 | 0.126 |
| D16 | 0.115 ± 0.001 | 0.120 |
| D17 | 0.176 | 0.166 |
| TW2 | 0.020 | 0.020 |

FIGS. 9 through 15 are plots of example slotted waveguide antenna with metamaterial structures performance characteristics. The data illustrated in FIGS. 9 through 15 was acquired using metamaterial structures that included SRR array 700 and composite wire structure 800, with dimensions generally as shown in Tables 1 and 2. The plots of FIGS. 9 through 14 correspond to simulated and measured antenna radiation pattern cuts illustrating directivity for a control SWA without metamaterial structures and the SWA with metamaterial structures. Simulated and measured data were acquired for vertical and horizontal oriented configurations as well as the control. Metamaterial structures that generally correspond to SRR array 700 and composite wire structure 800 with the dimensions of Table 1 and Table 2 were simulated and prototypes were constructed. The prototypes were formed on a substrate of 0.031 inch thickness with a dielectric coefficient of 2.2 and a 0.0009 loss tangent).

Figure 9:
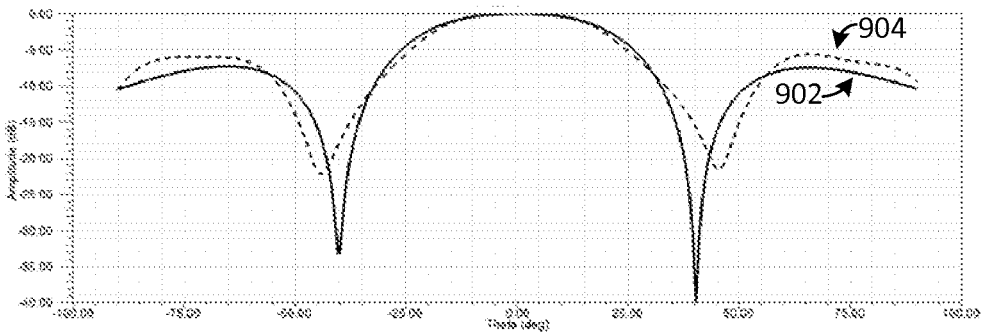
FIGS. 9 through 15 are plots of example slotted waveguide antenna with metamaterial structures performance characteristics.
Figure 10:
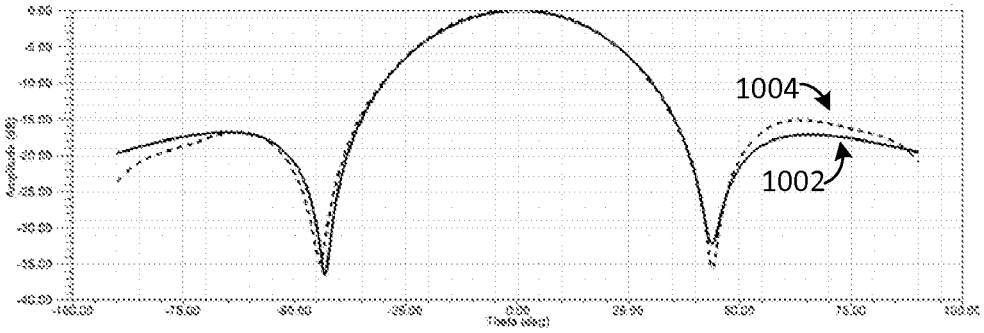
Figure 11:
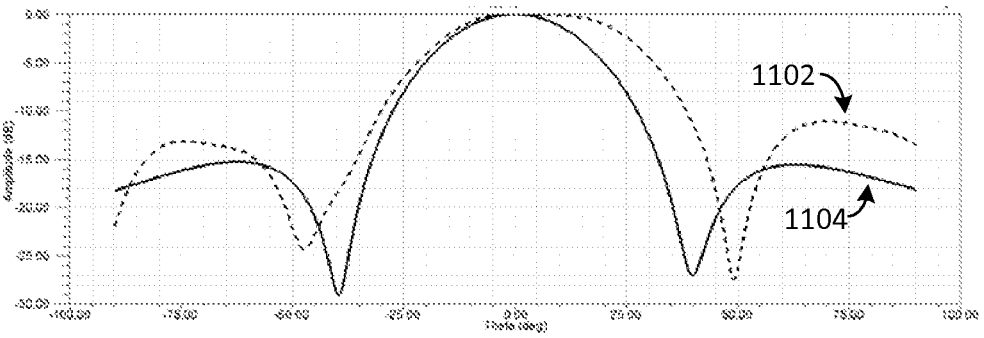
Figure 12:
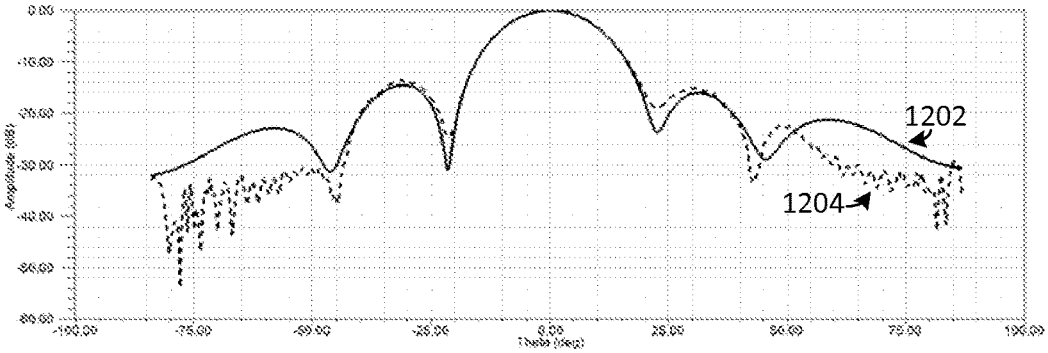
Figure 13:
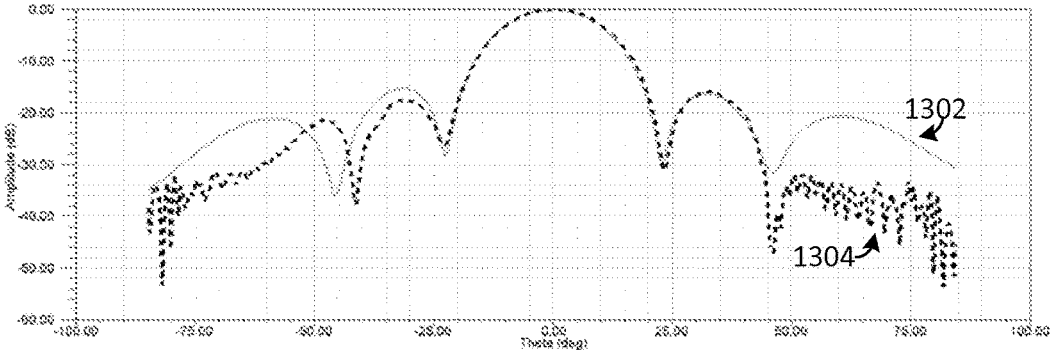
Figure 14:
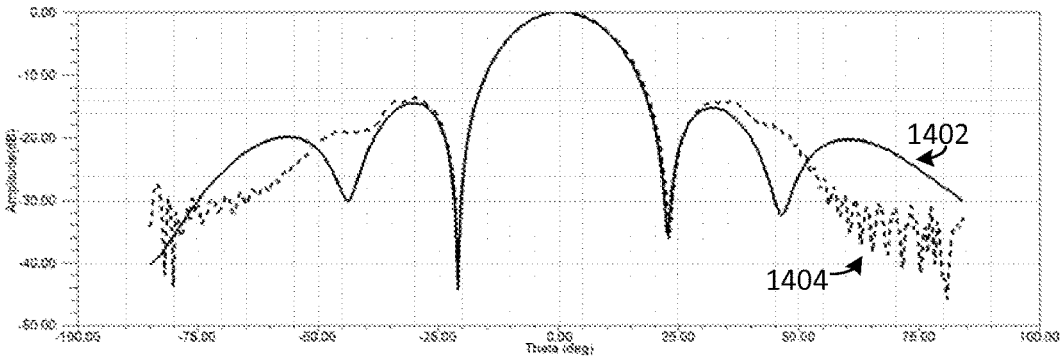

FIG. 9 through 11 illustrate plots of simulated 902, 1002, 1102 and measured 904, 1004, 1104 E-plane cuts for a SWA without metamaterial structures, with metamaterials structures oriented perpendicular ("vertical") to the SWA and with metamaterial structures oriented parallel ("horizontal") to the SWA, respectively. FIG. 12 through 14 illustrate plots of simulated 1202, 1302, 1402 and measured 1204, 1304, 1404 H-plane cuts for a SWA without metamaterial structures, with metamaterials structures oriented perpendicular to the SWA and with metamaterial structures oriented parallel to the SWA, respectively.

Tables 3 and 4 include parameters and data associated with FIGS. 9 through 11 and FIGS. 12 through 14, respectively. Parameters include gain, directivity, beamwidth, left sidelobe ("LSL") area and right sidelobe ("RSL") area. Table 3 includes data associated with simulated and measured E-plane cuts for a SWA without metamaterial structures, with metamaterials structures oriented perpendicular ("vertical") to the SWA and with metamaterial structures oriented parallel ("horizontal") to the SWA, respectively. With attention to the beamwidth for the E-plane cut for the vertical configuration, it is contemplated that instability in the test set up contributed to the variation in beamwidth between the simulated and measured data for this configuration.

TABLE 3

| | Control | | Horizontal | | Vertical | |
|---|---|---|---|---|---|---|
| Parameter | Simulated | Measured | Simulated | Measured | Simulated | Measured |
| Gain (dB) | N/A | 14.2 | N/A | 16.6 | N/A | 15.5 |
| Directivity (dB) | 15.3 | 15.5 | 17.02 | 17.07 | 17.1 | 16.0 |
| Beamwidth (deg) | 43.5 | 40.2 | 35.3 | 35.6 | 32 | 44.2 |
| LSL (dB) | −7.6 | −6 | −16.9 | −16.8 | −15.3 | −13.6 |
| RSL (dB) | −7.5 | −5.6 | −17.15 | −15.11 | −15.6 | −11.1 |

Table 4 includes data associated with simulated and measured H-plane cuts for a SWA without metamaterial structures, with metamaterials structures oriented perpendicular ("vertical") to the SWA and with metamaterial structures oriented parallel ("horizontal") to the SWA, respectively.

TABLE 4

| | Control | | Horizontal | | Vertical | |
|---|---|---|---|---|---|---|
| Parameter | Simulated | Measured | Simulated | Measured | Simulated | Measured |
| Gain (dB) | N/A | 14.2 | N/A | 16.6 | N/A | 15.5 |
| Directivity (dB) | 15.3 | 15.5 | 17.02 | 17.07 | 17.1 | 16.2 |
| Beamwidth (deg) | 18.8 | 18.7 | 19 | 19.5 | 18.7 | 19 |
| LSL (dB) | −14.5 | −13.9 | −15.3 | −17.75 | −14.5 | −13.65 |
| RSL (dB) | −16.13 | −14.9 | −16.3 | −16.92 | −15.3 | −14.64 |

Figure 15:
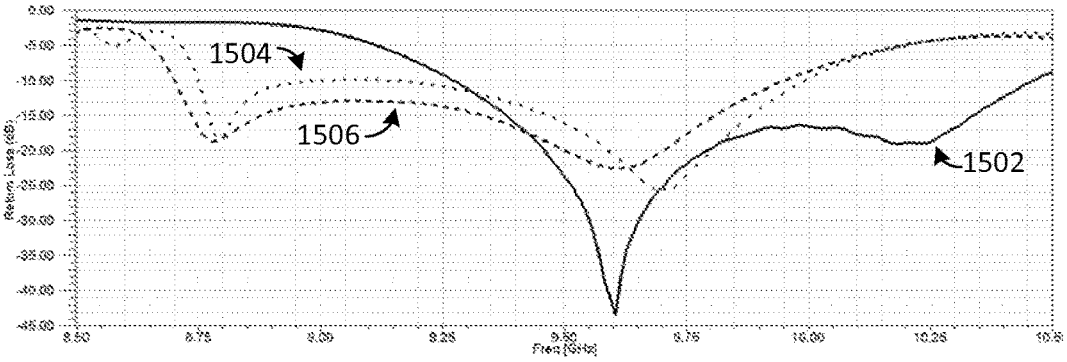

FIG. 15 illustrates return loss (i.e., S-parameter $S_{11}$) for an SWA, e.g., SWA 208 of FIGS. 2A and 2B, without metamaterial structures 1502, the SWA with parallel oriented metamaterial structures 1504 and the SWA with perpendicularly oriented metamaterial structures 1506.

Thus, a plurality of metamaterial structures may be positioned relative to the plurality of slots, external to a slotted waveguide antenna. In an embodiment, the metamaterial structures may be oriented in parallel with the surface of the SWA that defines the slots. In another embodiment, the metamaterial structures may be oriented perpendicular to the surface of the SWA that defines the slots. The metamaterial structures are configured to enhance one more performance characteristics of the SWA, as described herein.

According to one aspect, there is provided a system. The system includes a slotted waveguide antenna and a metamaterial structure positioned external to the waveguide. The slotted waveguide antenna includes a waveguide configured to enclose a waveguide cavity. The waveguide includes a first surface and a plurality of slots defined in the first surface, each slot configured to transmit and receive electromagnetic waves with frequencies in an operating frequency range. The metamaterial structure is configured to exhibit a negative effective permittivity and a negative effective permeability for the operating frequency range. The metamaterial structure includes a split ring resonator comprising an outer split ring and a concentric inner split ring, a substrate and a wire structure. The wire structure includes a first portion, a second portion and a third portion. The second portion is coupled between the first portion and the second portion. The first portion is oriented parallel to the third portion. The second portion is oriented perpendicular to the first portion and the third portion. A dimension of at least one of the first portion and the third portion is related to the operating frequency range.

According to another aspect, there is provided an apparatus. The apparatus includes a metamaterial structure configured to exhibit a negative effective permittivity and a negative effective permeability for an operating frequency range. The metamaterial structure includes a split ring resonator, a substrate and a wire structure. The split ring resonator includes an outer split ring and a concentric inner split ring. The wire structure includes a first portion, a second portion and a third portion. The second portion is coupled between the first portion and the second portion. The first portion is oriented parallel to the third portion and the second portion is oriented perpendicular to the first portion and the third portion. A dimension of at least one of the first portion and the third portion is related to the operating frequency range.

According to another aspect, there is provided an antenna system. The antenna system includes a slotted waveguide antenna. The slotted waveguide antenna includes a waveguide configured to enclose a waveguide cavity. The waveguide includes a first surface and a first plurality of slots defined in the first surface. Each slot is configured to transmit and receive electromagnetic waves with frequencies in an operating frequency range. The antenna system further includes the first plurality of metamaterial structures positioned external to the waveguide. Each metamaterial structure is positioned relative to a respective slot and configured to exhibit a negative effective permittivity and a negative effective permeability for the operating frequency range. Each metamaterial structure includes a second plurality of split ring resonators, a substrate and a composite wire structure. Each split ring resonator includes an outer split ring and a concentric inner split ring. The composite wire structure includes a composite first portion, the second plurality of second portions and a composite third portion. The second plurality of second portions is coupled between the composite first portion and the composite second portion. The composite first portion is oriented parallel to the composite third portion. The second portions are oriented perpendicular to the composite first portion and the composite third portion. A dimension of at least one of the composite first portion and the composite third portion is related to the operating frequency range.

Although illustrative embodiments and methods have been shown and described, a wide range of modifications, changes, and substitutions is contemplated in the foregoing disclosure and in some instances some features of the embodiments or steps of the method may be employed without a corresponding use of other features or steps. Accordingly, it is appropriate that the claims be construed broadly and in a manner consistent with the scope of the embodiments disclosed herein.

What is claimed is:

1. A system comprising:

a slotted waveguide antenna comprising a waveguide configured to enclose a waveguide cavity, the waveguide comprising a first surface and a plurality of slots defined in the first surface, each slot configured to transmit and receive electromagnetic waves with frequencies in an operating frequency range; and a metamaterial structure positioned external to the waveguide, the metamaterial structure configured to exhibit a negative effective permittivity and a negative effective permeability for the operating frequency range, the metamaterial structure comprising:

a split ring resonator comprising an outer split ring and a concentric inner split ring, each split ring comprising a respective conductive portion defining a respective nonconductive gap, a substrate having a first surface and an opposing second surface, the split ring resonator formed on the first surface of the substrate, and a conductive wire structure formed on the opposing second surface of the substrate, the conductive wire structure comprising a first portion, a second portion and a third portion, the second portion coupled between the first portion and the third portion, the first portion oriented parallel to the third portion, the second portion oriented perpendicular to the first portion and the third portion, wherein a dimension of at least one of the first portion and the third portion is related to the operating frequency range, the substrate is positioned between the split ring resonator and the wire structure and the metamaterial structure has a thickness comprising a thickness of the substrate, a thickness of the split ring resonator and a thickness of the conductive wire structure.

2. The system of claim 1, wherein the metamaterial structure is oriented perpendicular to the first surface of the slotted waveguide antenna.

3. The system of claim 1, wherein the metamaterial structure is oriented parallel to the first surface of the slotted waveguide antenna.

4. The system of claim 1, wherein the metamaterial structure is positioned a non-zero distance from the first surface of the slotted waveguide antenna.

5. The system of claim 1, further comprising a metamaterial structure assembly comprising a plurality of metamaterial structures, the metamaterial structure assembly configured to facilitate positioning each metamaterial structure relative to a respective slot.

6. The system of claim 1, wherein the metamaterial structure comprises a plurality of metamaterial unit cells, each metamaterial unit cell comprising a respective split ring resonator and a respective wire structure.

7. The system of claim 6, wherein a respective dimension of each of the first portion and the third portion differs for the plurality of metamaterial unit cells.

8. The system of claim 1, wherein the metamaterial structure comprises a plurality of split ring resonators and the wire structure is a composite wire structure, the composite wire structure comprising a composite first portion, a composite third portion and a plurality of second portions.

9. The system of claim 8, wherein at least one of the composite first portion and the composite third portion is positioned asymmetrically with respect to a centerline of the metamaterial structure.

10. The system of claim 1, wherein the operating frequency range has a maximum operating frequency in the range of 8 gigahertz (GHz) to 12 GHz.

11. An apparatus comprising:

a metamaterial structure configured to exhibit a negative effective permittivity and a negative effective permeability for an operating frequency range, the metamaterial structure comprising:

a split ring resonator comprising an outer split ring and a concentric inner split ring, each split ring comprising a respective conductive portion defining a respective nonconductive gap, a substrate having a first surface and an opposing second surface, the split ring resonator formed on the first surface of the substrate, and a conductive wire structure formed on the opposing second surface of the substrate, the conductive wire structure comprising a first portion, a second portion and a third portion, the second portion coupled between the first portion and the third portion, the first portion oriented parallel to the third portion, the second portion oriented perpendicular to the first portion and the third portion, wherein a dimension of at least one of the first portion and the third portion is related to the operating frequency range, the substrate is positioned between the split ring resonator and the wire structure and the metamaterial structure has a thickness comprising a thickness of the substrate, a thickness of the split ring resonator and a thickness of the conductive wire structure.

12. The apparatus of claim 11, wherein the metamaterial structure comprises a plurality of metamaterial unit cells, each metamaterial unit cell comprising a respective split ring resonator and a respective wire structure.

13. The apparatus of claim 12, wherein a respective dimension of each of the first portion and the third portion is the same for each metamaterial unit cell.

14. The apparatus of claim 12, wherein a respective dimension of each of the first portion and the third portion differs for the plurality of metamaterial unit cells.

15. The apparatus of claim 11, wherein the metamaterial structure comprises a plurality of split ring resonators and the wire structure is a composite wire structure, the composite wire structure comprising a composite first portion, a composite third portion and a plurality of second portions.

16. The apparatus of claim 15, wherein at least one of the composite first portion and the composite third portion is positioned asymmetrically with respect to a centerline of the metamaterial structure.

17. The apparatus of claim 11, wherein the operating frequency range has a maximum operating frequency in the range of 8 gigahertz (GHz) to 12 GHz.

18. An antenna system comprising:

a slotted waveguide antenna comprising a waveguide configured to enclose a waveguide cavity, the waveguide comprising a first surface and a first plurality of slots defined in the first surface, each slot configured to transmit and receive electromagnetic waves with frequencies in an operating frequency range; and a first plurality of metamaterial structures positioned external to the waveguide, each metamaterial structure positioned relative to a respective slot and configured to exhibit a negative effective permittivity and a negative effective permeability for the operating frequency range, each metamaterial structure comprising:

a split ring resonator array comprising a second plurality of split ring resonators, each split ring resonator comprising an outer split ring and a concentric inner split ring, each split ring comprising a respective conductive portion defining a respective non-conductive gap, a substrate having a first surface and an opposing second surface, the split ring resonator array formed on the first surface of the substrate, and a composite wire structure formed on the opposing second surface of the substrate, the composite wire structure comprising a composite first portion, a second plurality of second portions and a composite third portion, the second plurality of second portions coupled between the composite first portion and the composite third portion, the composite first portion oriented parallel to the composite third portion, the second portions oriented perpendicular to the composite first portion and the composite third portion, wherein a dimension of at least one of the composite first portion and the composite third portion is related to the operating frequency range and a centerline of the split ring resonator array is aligned with a centerline of the composite wire structure.

19. The antenna system of claim 18, wherein the plurality of metamaterial structures are oriented perpendicular to the first surface of the slotted waveguide antenna.

20. The antenna system of claim 18, wherein the plurality of metamaterial structures are oriented parallel to the first surface of the slotted waveguide antenna.

* * * * *